US006032299A

United States Patent [19]

Welsh

[11] Patent Number: 6,032,299

[45] Date of Patent: Mar. 7, 2000

[54] JACKET FOR REDUCING SPINAL AND COMPRESSION INJURIES ASSOCIATED WITH A FALL FROM A MOVING VEHICLE

[76] Inventor: Nicole Welsh, 3659 Taylor's Ville Rd., Shelbyville, Ky. 40065

[21] Appl. No.: 08/550,286

[22] Filed: Oct. 30, 1995

[51] Int. Cl.[7] ..... A41D 13/00

[52] U.S. Cl. ..... 2/456; 2/465; 2/467; 2/468; 2/DIG. 3

[58] Field of Search ..... 2/462, DIG. 3, 2/3, 908, 912, 455, 456, 459, 465, 467, 468; 280/735, 733, 736, 728.1, 730.1

[56] References Cited

U.S. PATENT DOCUMENTS

| | | | |
|---|---|---|---|
| 3,827,716 | 8/1974 | Vaughn et al. . | |
| 4,059,852 | 11/1977 | Crane | 280/730 |
| 4,089,065 | 5/1978 | McGee . | |
| 4,303,904 | 12/1981 | Chasek . | |
| 4,637,074 | 1/1987 | Taheri . | |
| 4,685,151 | 8/1987 | Kincheloe . | |
| 4,739,328 | 4/1988 | Koelle et al. . | |
| 4,825,469 | 5/1989 | Kincheloe | 2/DIG. 3 |
| 4,977,623 | 12/1990 | DeMarco | 2/DIG. 3 |
| 4,984,821 | 1/1991 | Kim et al. | 280/728 |
| 5,030,807 | 7/1991 | Landt et al. . | |
| 5,086,389 | 2/1992 | Hassett et al. . | |
| 5,091,992 | 3/1992 | Pusic . | |
| 5,133,084 | 7/1992 | Martin . | |
| 5,335,884 | 8/1994 | Kalberer et al. . | |
| 5,362,098 | 11/1994 | Guill | 280/735 |
| 5,390,367 | 2/1995 | Rush, III . | |
| 5,394,563 | 3/1995 | Doyle . | |
| 5,402,535 | 4/1995 | Green . | |
| 5,421,610 | 6/1995 | Kavannaugh et al. . | |
| 5,500,952 | 3/1996 | Keyes | 2/DIG. 3 |
| 5,535,446 | 7/1996 | Pusic | 2/456 |
| 5,558,627 | 9/1996 | Singer et al. | 2/DIG. 3 |

*Primary Examiner*—C. D. Crowder
*Assistant Examiner*—Larry D. Worrell, Jr.
*Attorney, Agent, or Firm*—Curtis A. Vock

[57] ABSTRACT

A jockey jacket actuates upon sensing a particular event, such as the jockey falling from the horse during a race. A series of air tracks are inflated by a gas generator to pump up a series of air-pockets, mini-airbags, and a collar protection region, preferably with a series of concentric circular cylinders which expand and provide resistance to motions that are transverse to the concentric axis. A plurality of caps are telescopically disposed within the tracks and are forced upwards by the injected gas. These caps form a column that, together with the other columns and a support member Within the jacket collar, forms an exoskeleton around the jockey's neck. A base webbing provides support for the columns. The jacket includes microelectronics to control the jacket actuation. The jacket is usable for other activities, such as motorcycling.

23 Claims, 28 Drawing Sheets

JACKET FOR REDUCING SPINAL AND COMPRESSION INJURIES ASSOCIATED WITH A FALL FROM A MOVING VEHICLE

BACKGROUND

Jockeys risk spinal injury each time they ride a horse, particularly during a race. Many jockeys have sustained serious and sometimes fatal injury by falling from their horse and/or by being crushed or trampled by a horse after a fall. Typically, other than a protective helmet and a rugged riding jacket, nothing operates to protect the jockey's body from such injury.

The physical forces of physics at work during a horse race are very large; and they do not favor the jockey. For example, an average horse weighs 1200 lbs, while a typical jockey weighs only 110 lbs. When such a horse lands on a jockey, a crushing blow is delivered to the body. Further, a horse's average racing speed is 32 or 33 mph. Most jockeys, if thrown from the horse, unfortunately land on their heads at approximately the same speed, thereby incurring a massive torque or shearing blow to the cervical spine, the area which is most susceptible to paralyzing injury.

From 1960–1994, the Jockeys Guild estimates that 2,500 jockey-related injuries occur each year, with an average of two deaths and 2.5 paralyzing injuries nationwide. As of mid-1995, the Jockeys Guild has classified 45 U.S. jockeys as being permanently disabled from their injuries. The Jockey's Guild classification does not list jockeys from other countries, some of which are very active in horse racing, and some of which offer little, if any, precautionary measures against injury, such as training and thoroughly-tested headgear.

In addition to the pain and sorrows suffered by these jockeys and their families, the known risks associated with professional horse racing have resulted a substantial insurance liability. Accordingly, the race tracks around the United States are heavily insured as a protection against the riding accidents which will certainly occur, given enough time. In addition to being financially burdensome to the race track owners, the insurance policies and monetary settlements do little to comfort those jockeys, or their families, who are permanently injured by a fall.

Jockeys are not the only persons at risk. Casual horseback riders, hunters and professional jump competitors are also susceptible to similar injury. For example, Christopher Reeve, the well-known actor who played "Superman" in several movies, recently sustained a permanent compression injury to the spine during a head-long fall from his horse. He, like many other riders, is not expected to walk again.

Other sports and occupations offer comparable risks. Motorcyclists, for example, can easily incur spinal injury and death from an accident or fall from a motorcycle.

Spinal injuries resulting from motorcycling and horseback riding are ranked, respectively, as numbers 5 and 17 by the Birmingham National Spinal Cord Statistical Center. See, the Los Angeles Times and the Washington Post. Given the large numbers of spinal injuries each year in the United States, these two sports are appropriately labled as "high risk" from insurers and other professionals.

It is, accordingly, an object of the invention to provide a jacket which operates to protect a user from a fall from a vehicle such as a horse or motorcycle.

Still another object of the invention is to provide a jockey jacket which actuates upon a detected fall from a horse, and which operates to protect the jockey's body, and particularly the neck, during the fall and subsequent trauma associated with the fall.

These and other objects will become apparent in the description which follows.

SUMMARY OF THE INVENTION

Briefly, the invention provides, in one aspect, a jockey jacket which protects jockeys who fall from their horse, particularly during a race. The jacket of the invention offers protection in two primary ways. By actuation of gas and/or mechanical structure around the neck, the jacket resists motions that cause cervical injury; and by pressurizing a plurality of mini-airbags within the lining of the jacket, other traumas such as a blow to the body are cushioned so that the impact energies are distributed across the body and/or dissipated through pressurized release.

In another aspect, the invention provides a jacket for protecting the wearer from injury during a fall from a vehicle. One or more layers form the jacket; and a plurality of airpockets are woven into the jacket. Each of the airpockets are in fluid communication with other airpockets and are expandable in response to increased pressurization. A gas generator pressurizes the airpockets, and one or more pressurization tubes communicate gas between the gas generator and the airpockets. A regulator controls the gas flow between the gas generator and the airpockets, and is responsive to a signal generated when the wearer of the jacket falls from the vehicle.

The vehicles suitable for use with the invention include a horse, a motorcycle, a snowmobile, a bobsled, and a bicycle.

In still another aspect, the jacket includes a plurality of mini-airbags sewn within the jacket and connected to the gas generator by one or more gas conduits. The mini-airbags are responsive to increased pressurization to provide cushioning within the jacket. The regulator, in this aspect, thus controls the gas flow from the gas generator through the conduits and to the mini-airbags.

Preferably, the jacket has a collar portion and one or more circular cylinders connected to the collar portion. The cylinders are connected to the gas generator by one or more pressurization tubes, and are expandable in response to increased pressurization to substantially surround the wearer's neck to create a resistance against sideways movement of the wearer's head.

In still another aspect, the jacket includes a pressure sensor to sense pressure within at least one of the airpockets. The sensor generates a pressure signal representative of the pressure therein. A pressure regulator, including a microprocessor, connects to the pressure sensor to control pressurization within the airpockets by controlling the flow of gas into or out of the airpockets in response to the pressure signal.

By way of example, the pressure regulator can include a valve for releasing pressure from the airpockets in response to signals generated by the microprocessor means.

The pressure regulator can also include a valve which connects to the gas generator to inject air selectively into the airpockets in response to signals generated by the microprocessor. Preferably, the pressure regulator further controls the pressurization within the airpockets according to a non-linear function of pressure and time.

In one aspect, the jacket includes a collar portion. A base webbing is woven within the jacket, extending circumferentially about the jacket and in a horizontal position relative to a normal upward posture of a wearer of the jacket. A collar structure, within the collar region of the jacket, is substantially rigid and extends circumferentially about the collar region such that the collar structure surrounds at least part of the neck of a wearer of the jacket. A plurality of tracks are woven within the jacket and are arranged substantially vertically between a base of the jacket and the collar portion. A plurality of caps are within each of the tracks. The caps are formed of a sturdy material and are responsive to pressurization within the tracks to accelerate towards the neck, the lower-most cap connecting to the base webbing once the lower-most cap accelerates past the base webbing. In total, once the jacket is pressurized, the caps form a substantially rigid column to form an exo-skeleton about the neck, protecting the neck during the fall.

The jacket can also include an attached helmet, which has at least two straps connected to the helmet, where each of the straps are connected with a track such that the column connects substantially into the helmet.

In another aspect, a collar portion of the jacket has a plurality of circular cylinders connected to the collar portion. Each of the cylinders have a different radial size and are arranged sequentially according to radial size, with the smaller radial cylinders on top of larger radial cylinders. The cylinders are connected to the gas generator by one or more pressurization tubes, and are expandable in response to increased pressurization to substantially surround the wearer's neck to create a resistance against sideways movement of the wearer's head.

The invention also provides for a method of protecting a jockey during a fall from a horse, comprising the steps of: sensing information indicative of the jockey falling from the horse; generating a pressurization signal, in response to the information, to pressurize a jacket worn by the jockey, the jacket having a gas generator, responsive to the pressurization signal, and a plurality of airpockets, connected to the gas generator, that are expandable with pressurization to cushion the jockey; and controlling gas flow between the gas generator and the airpockets to provide a substantially smooth landing during the fall.

The invention is next described further in connection with preferred embodiments, and it will become apparent that various additions, subtractions, and modifications can be made by those skilled in the art without departing from the scope of the invention.

BRIEF DESCRIPTION OF THE DRAWINGS

A more complete understanding of the invention may be obtained by reference to the drawings, in which.

DETAILED DESCRIPTION OF THE DRAWINGS

Figure 1:
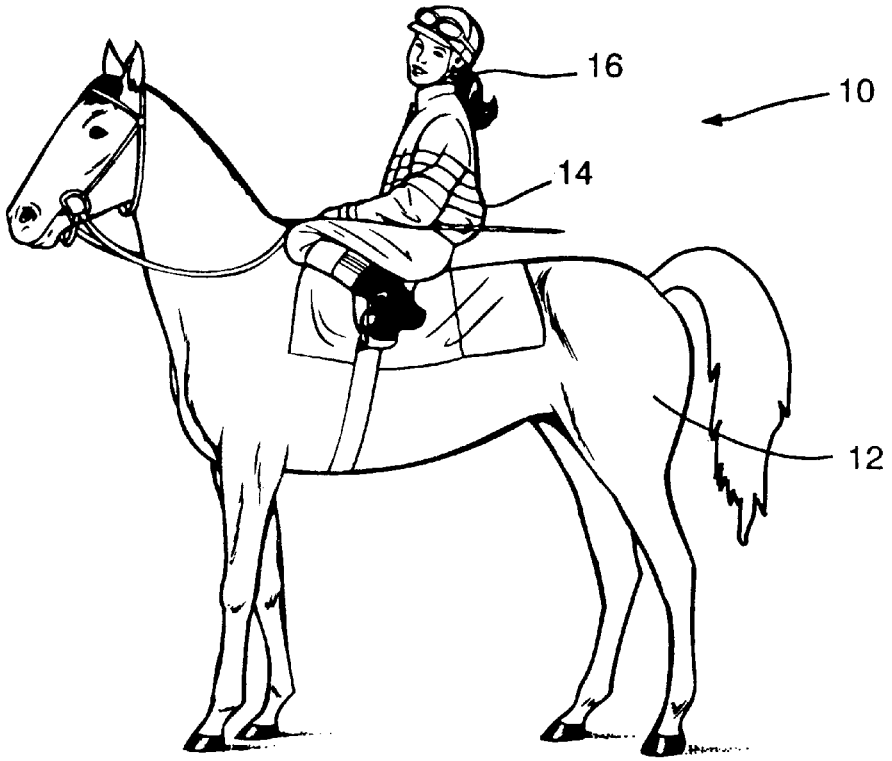
FIG. 1 illustrates a jockey riding a horse and wearing a jacket constructed according to the invention.

FIG. 1 illustrates a jockey 10 riding a horse 12 and wearing a jacket 14 constructed according to the invention. As described in more detail below, the jacket 14 includes a series of pressure conduits and pockets, sometimes referred to herein as "airbags" or "bubble-wrap," which inflate through controls within the jacket and upon the happening of certain events. Further, the jacket 14 in a preferred embodiment includes a series of telescopically disposed caps which interconnect, upon actuation of the jacket, to form a rigid column around the jockey's neck 16. In this way, the jacket of the invention both resists motions that cause cervical injury, and cushions the jockey's body against other traumas that can occur during a fall, such as when a horse steps on the unsuspecting jockey 10.

Briefly, the jacket 14 "senses" when the jockey leaves the horse 12 in a terminal trip to the ground, and actuates the jacket to provide a force-resistant shield and cushion around the jockey. This actuation occurs before the jockey reaches the ground, so that the protective features of the jacket 14 are fully deployed to provide maximum possible protection against spinal and trauma-induced injuries.

The actuation of the jacket 14 must therefore occur rapidly, since a typical jockey traveling at twenty-five miles-per-hour reaches the ground in less than 0.65 seconds. Accordingly, the invention preferably determines that the jockey has left the horse for a terminal trip within about 0.3 seconds so that the jacket 14 is fully deployed within the following 0.3 seconds.

The physics associated with a jockey's fall from the horse are complex and generate substantial forces. At the point of impact, a jockey 14 can have a downward velocity of approximately 253 inches per second, and a forward velocity of about 440 inches per second. The resulting accelerations experienced by the jockey thus exceed 330 in/s^2. The jacket of the invention must therefore absorb a majority of the energy associated with these velocities to protect the jockey upon landing; and the absorption of deceleration energies must occur within a very short time and through very small displacement.

The jacket 14 of the invention includes a plurality of mini-airbags, described in more detail below, which are sewn within the lining of the jacket. Upon actuation, those airbags deploy to cushion the body's fall, as well the blows to the body, so that the impact energies are distributed across the body and/or dissipated through pressurized release of air within the airbags.

Figure 2:
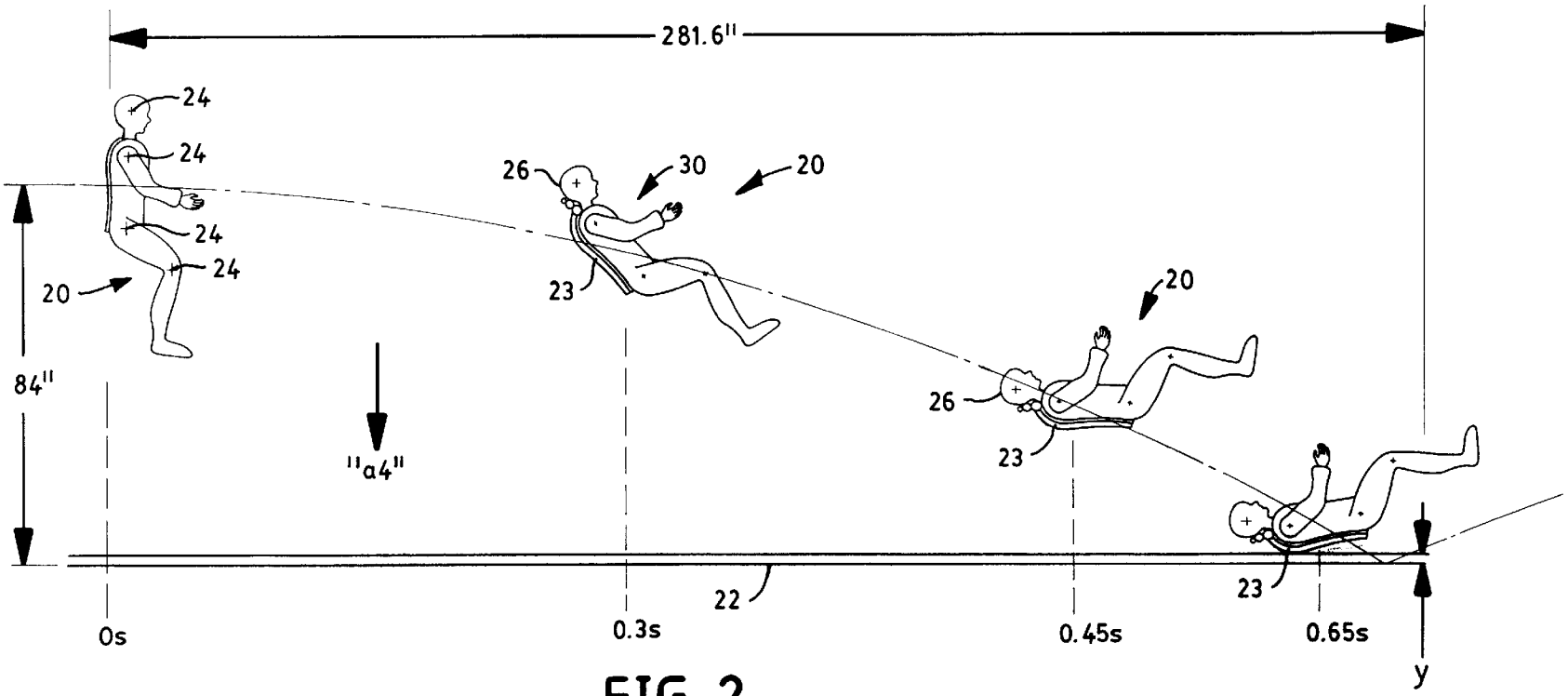
FIGS. 2, 2A and 2B illustrate the physical phenomenon experienced by a jockey during a typical fall from a racing horse.
Figure 2A:
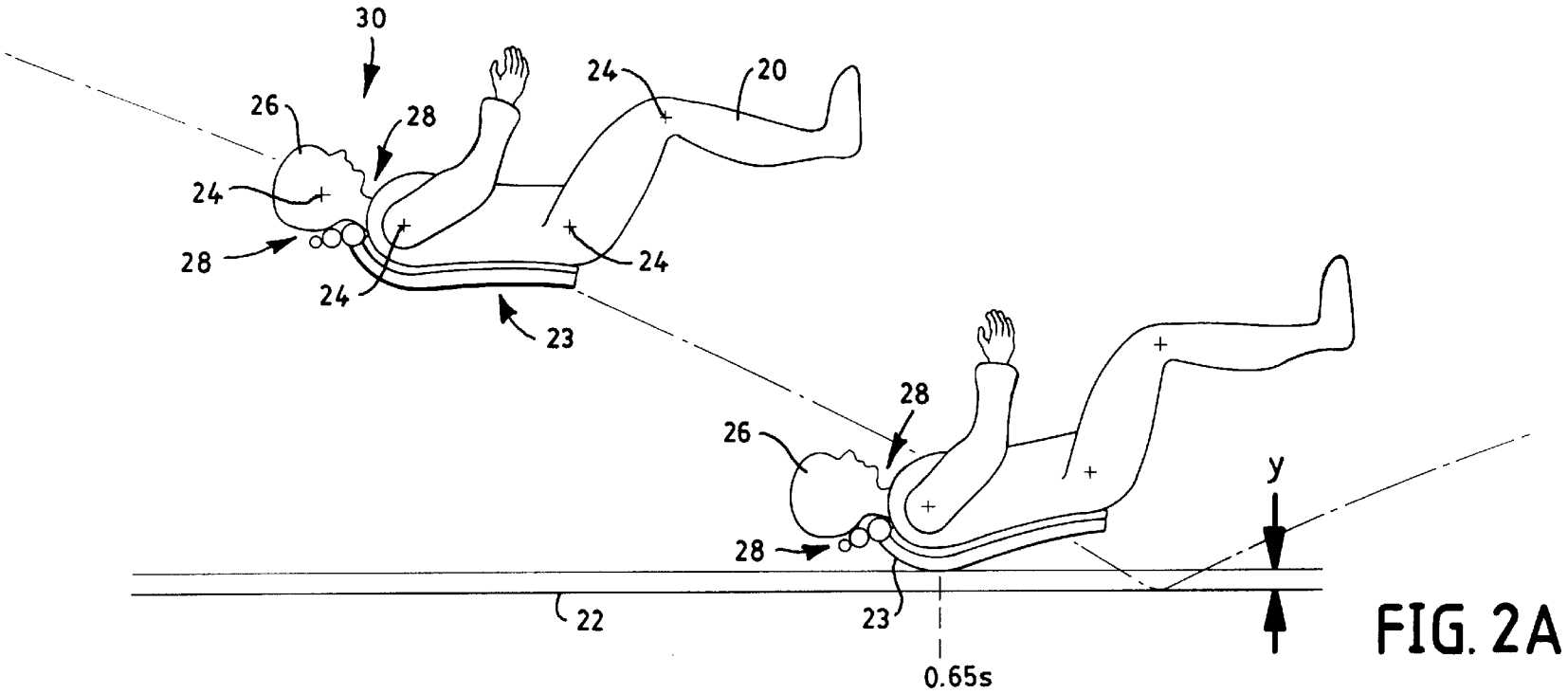
Figure 2B:
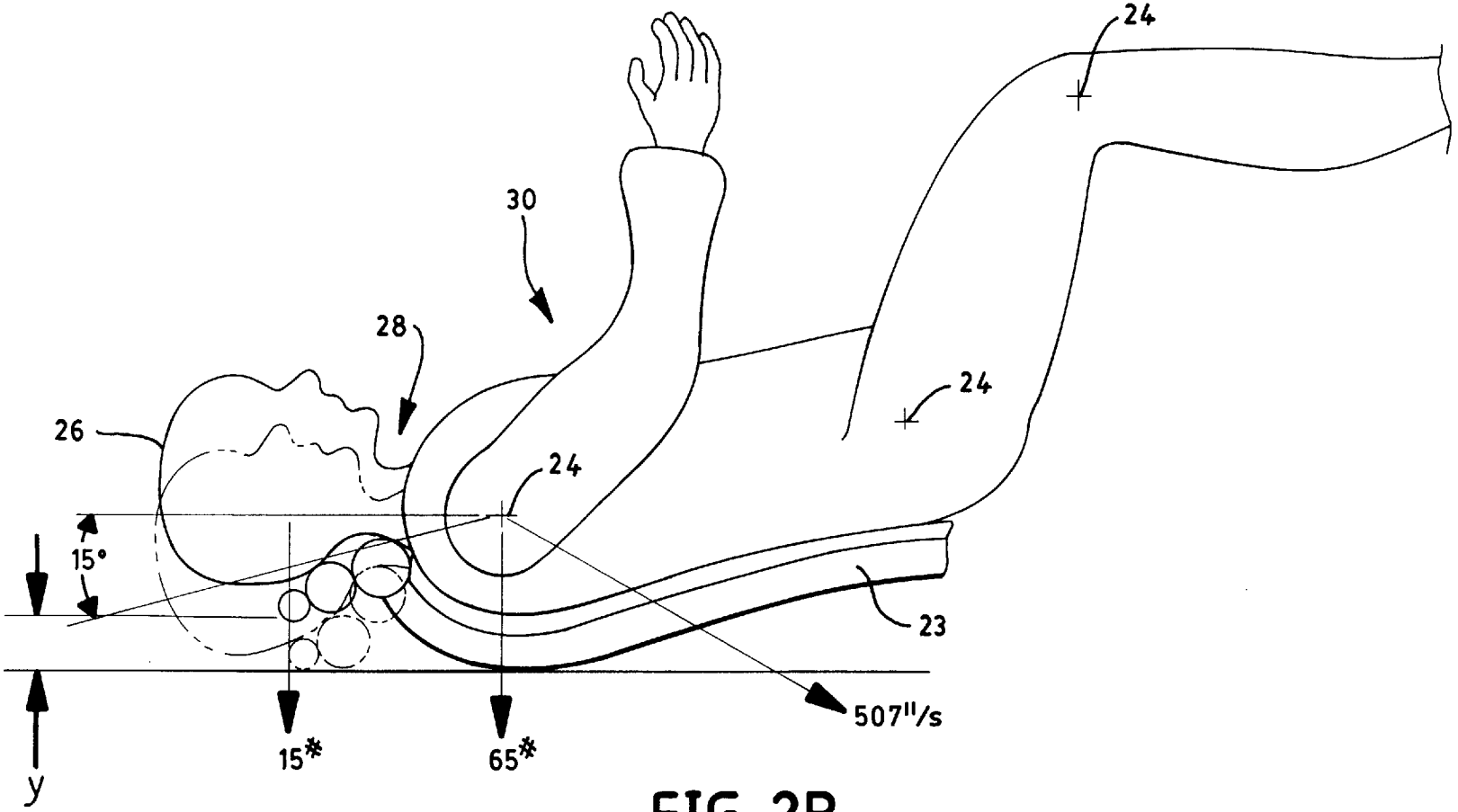

By way of example, FIG. 2 illustrates a structural model of a jockey 20 who experiences an impact and fall-scenario by accelerating into the ground 22. FIGS. 2A and 2B illustrates additional and close up detail of the scenario of FIG. 2. The airbags are schematically illustrated as structure 23; and the joints 24 of the jockey 20 represent moment arms within the analytical model used to analyze the fall scenario shown in FIGS. 2, 2A, 2B. The specifics of the fall scenario of FIG. 2 are as follows:

120 lb jockey 25 mph horse speed airbags deploy within 0.3 s jockey head is 15 lbs; jockey torso is 65 lbs; jockey arms and legs are 40 lbs maximum airbag deployment is 2 inches With specific reference to FIGS. 2, 2A, 2B, a downward acceleration "a4" is realized by the jockey 20 upon impact with the ground 22. Because the typical and practical depth of the deployed airbags is about two inches, shown illustratively as distance "y" in FIGS. 2, 2A, 2B, energies of approximately 25,0000 in/s^2, or 65 "g" must be dissipated within a time interval of about 0.010 s. It is the very nature of these high deceleration values which require the use of cushioning at the body's vital parts to absorb and dissipate the expected injury-causing energies.

In the likely event that the jockey of a real fall is inverted, relative to the scenario illustrated in FIGS. 2, 2A, 2B, the jockey's neck is subject to all of the impact forces described therein. In order to protect this area, therefore, the energy absorbing features of the invention should operate to absorb these forces.

Specifically, as the body 20 hits the ground 22, the unprotected head 26 of jockey 20 is forced into the ground with a velocity of 253 in/s, given the scenario outlined above. When the jockey's head 26 weighs approximately 15 lbs, a total of about 1200 in/lbs of energy should be dissipated in the collar protection area 28, illustrated in FIGS. 2A, 2B and denoted herein as the "CPA," and 5300 in/lbs of energy should be dissipated in the torso area 30. In the illustrated scenario of FIG. 2, the airbag deployment provides an air cushion of at least two inches, resulting in a deceleration time of 0.010 s for 384 in/s^2 accelerations.

The energy absorption at the jockey's head 26 should therefore exceed 1200 in/lbs, which dictates the spring constant required in the CPA:

$$\frac{1}{2}Ky^2 \cong 1200\,\text{lbs}$$

where K is the spring constant of the CPA and where y is the cushion displacement provided by the airbags 23. From this equation, the CPA K factor is about 600 in/lb. With an airbag contact area of about 50 in^2, the required CPA pressure needed to provide the needed K factor is 24 p.s.i. at initial conditions.

In a similar fashion, the spring constant for the torso region 30 is dissipated through a spring constant of 2650 in/lbs (i.e., to dissipate the expected loadings of 5300 in/lbs). With the jacket's airbag 23 providing up to 300 in^2 of area coverage across the jockey's torso, the dissipation energies are achieved through pressurization of at least 17 p.s.i.

Accordingly, the jacket of the invention is preferably deployed with pressurization of at least 25 p.s.i. in the neck region, and 17 p.s.i. in the torso region. However, other factors influence these values, such as the control rate at which air escapes from the airbag—providing fundamental dissipation to the impact energies. Other factors are discussed in more detail below.

Figure 3:
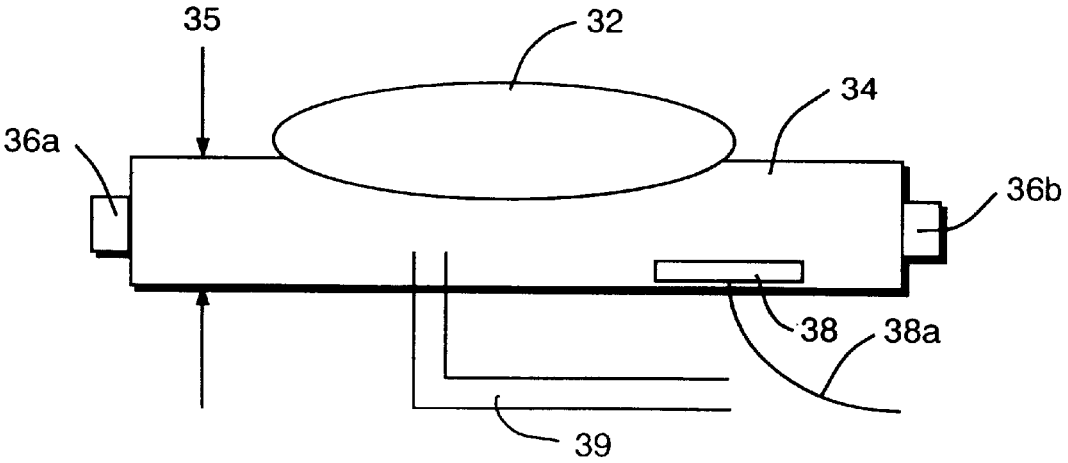
FIG. 3 illustrates one pressurization system, constructed according to the invention, which dissipates energy by releasing and injecting air in a controlled manner.

The design of the airbag compartments at the head and torso regions, 26 and 30, respectively, are discussed at length below. In the preferred embodiment of the invention, the jockey jacket maintains the airbag pressurization at a selected percentage of the final pressures needed for impact and deceleration. For example, a percentage of 60% of the initial pressure is acceptable as a quantitative value during the whole impact scenario. FIG. 3 illustrates how the invention maintains a reduced pressurization percentage during impact.

Specifically, FIG. 3 illustrates a representative body portion 32, such as the jockey's head 26 or torso 30. The airbag 34 is representative of the CPA, for example, and is preferably at least two inches in depth 35 to provide enough air to adequately dissipate the expected impact energies. Pressure relief valves 36*a*, 36*b*, known to those skilled in the art, provide an escape for the air within the airbag 34. Once the airbag is compressed, the pressure within the airbag 34 increases, in a manner that is, approximately, inversely proportional to the compression. A pressure sensor 38, known to those skilled in the art, detects pressure within the airbag 34, and connects to a microprocessor, via signal line 38*a*, and as described in more detail below, to provide real-time measurements of the pressure within the airbag 34. An air-feed conduit 39 provides an avenue for pressurizing the airbag 34, as needed and as appropriate, for the given fall scenario. A command signal from the microprocessor (not shown in FIG. 3) causes gas to inflate the airbag 34 through the air-feed conduit 39, such as described in more detail below.

At impact, therefore, the body portion 32 is forced into the airbag 34, causing an increase of pressure. Part of the air within the airbag 34 is allowed to escape through the valves 36*a*, 36*b* to dissipate the energy of the fall. However, additional energy will generally be required to absorb all the energies in a controlled and smooth fashion. Accordingly, air is simultaneously pumped into the airbag through the air-feed conduit 39 at a rate slightly below that of the pressure relief valves, and this pumping action is non-linear to smoothly absorb the deceleration forces experienced by the body portion 32 during the fall. The re-inflation of the airbag 34 thus maintains a desired pressure to expend the kinetic energy from the fall and to control deceleration into a smooth stop, Without "bouincing."

Figure 3A:
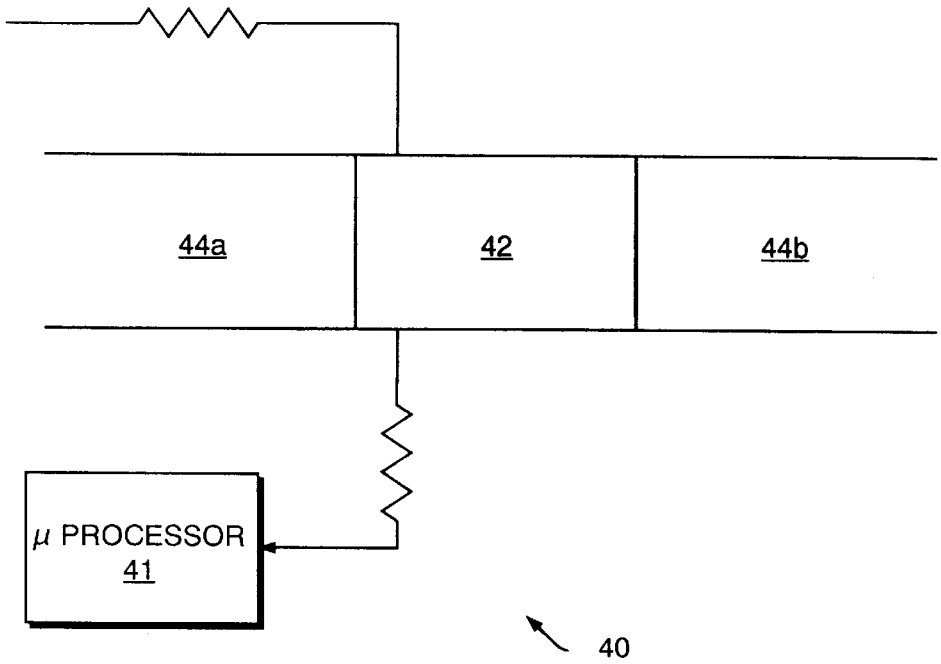
FIGS. 3A, 3B, and 3C illustrate valves for controlling the air flow into and out of the system illustrated in FIG. 3.
Figure 3B:
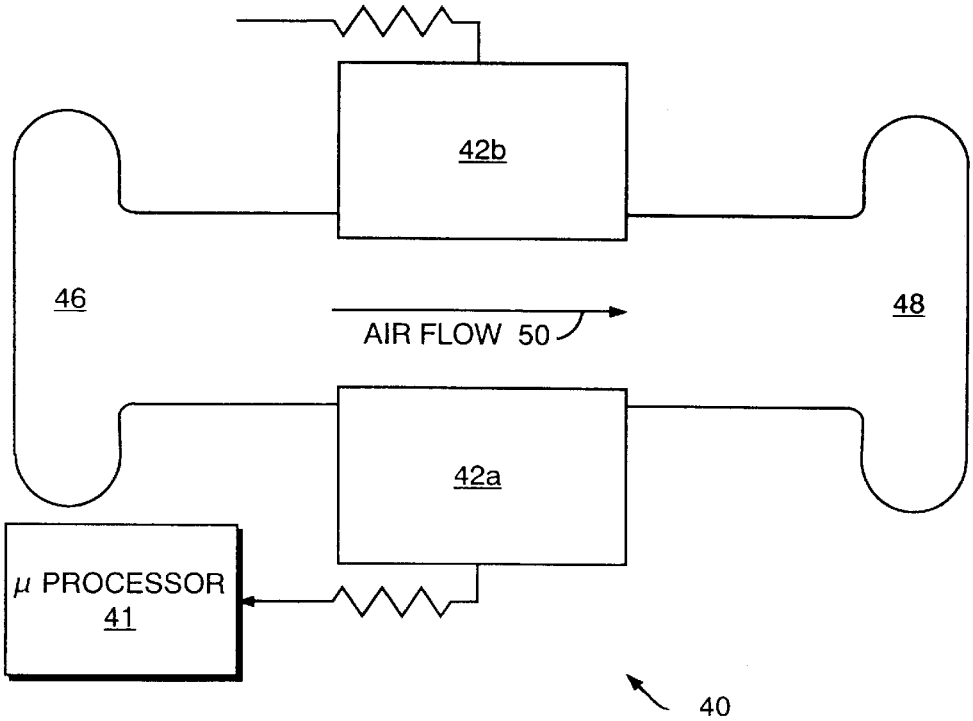

The control of air to within the airbag 34 and through the air-feed conduit 39 can be accomplished in several ways. FIGS. 3A and 3B illustrate one way where a piezo-type pressure valve 40 is controlled by a microprocessor 41, described in more detail below. By controlling the voltage across the crystal 42, the crystal 42 can be expanded to seal the pressure flow between high pressure 44*a* and lower pressure 44*b*, such as shown in FIG. 3A. By inverting the voltage across the crystal 42, the crystal relaxes such that an air flow is created between the gas source 46 and the airbag 48, such as illustrated in FIG. 3B. Note that the piezo crystal 42 of FIG. 3B is illustratively shown in two parts 42*a*, 42*b*, although other valve designs utilize a single crystal 42. In accord with the invention, the air flow 50 between the source 46 and the airbag 48 is therefore controllable to augment the deceleration and pressure-sensing capabilities of the system described in FIG. 3.

Figure 3C:
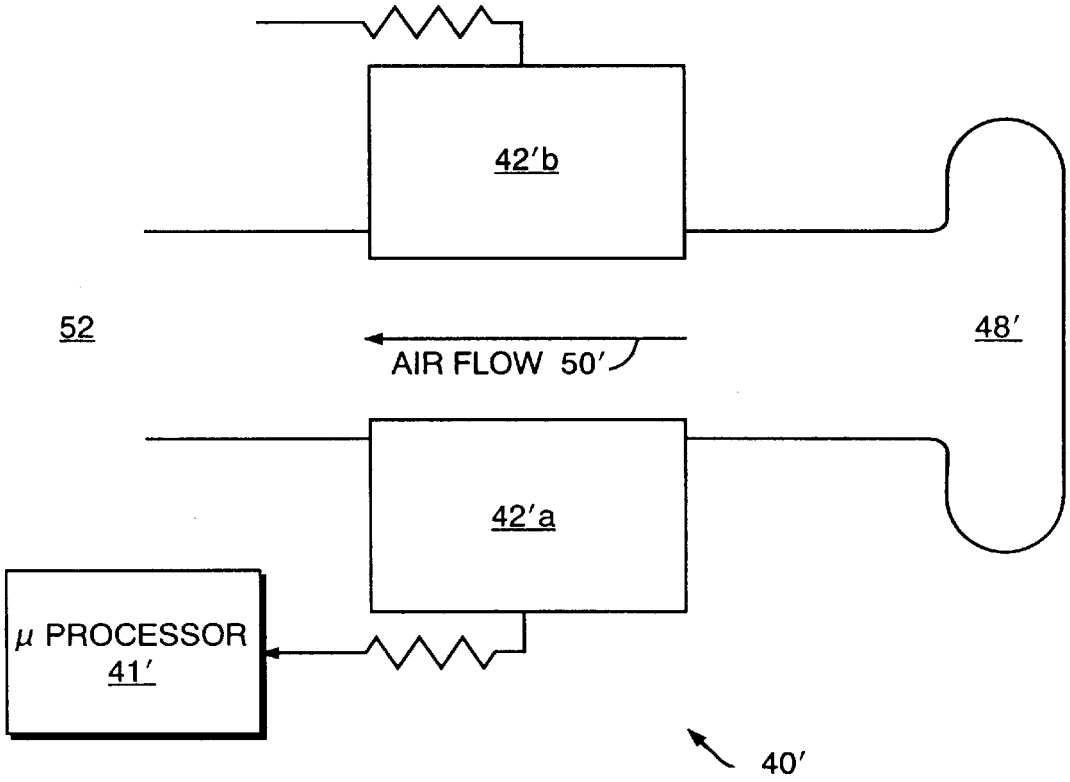

Alternatively, the control circuitry of the microprocessor can be connected directly to the pressure release valves 36*a*, 36*b* to directly control the air flow escaping from the airbag. Providing there is sufficient air to expend to absorb the impact energies, no additional air needs to be injected into the airbag 34, making the air-feed conduit 39 unnecessary. FIG. 3C illustrates this embodiment, where the valve 40' functions as each of the valves 36*a*, 36*b*. By sensing pressure within the airbag 34, a control signal from the microprocessor 41' to the piezocrystal 42*a*', 42*b*' modifies the pressure flow 50' and changes the rate at which air is expended from the airbag 48'. This expended air is expelled freely into the outside air 52, i.e., the region exterior to the jacket.

The pressure control embodiments illustrated in FIGS. 3, 3A, 3B, 3C can be discussed by an analogy of a hammer hitting a beach ball. Under normal conditions, a hammer hitting a beach ball will decelerate rapidly, and then bounce backwards towards the person operating the hammer (providing of course that the beach ball remains intact). This behavior is not desirable, for example, in the CPA area of the invention. Accordingly, by controlling the flow of air into or out of the airbag, the body is decelerated smoothly, and all the impact energies are absorbed. By analogy, the hammer hitting the beach ball preferably stops, without bouncing backwards, at a position between the front surface of the beach ball, where the hammer first contacted the ball, and the back surface, where the ball is in contact with the ground. In a similar fashion, the jockey's body such as the head and torso are absorbed within the airbag depth 34, FIG. 3.

Figure 4:
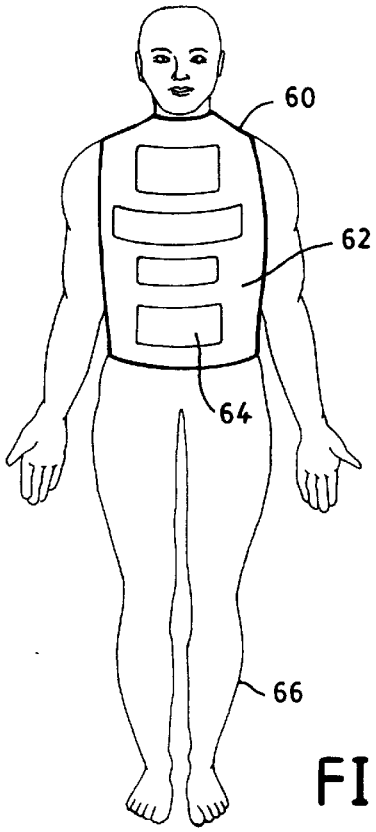
FIGS. 4 and 4A illustrate jockey jackets, constructed according to the invention, and with airbags of differing sizes sewn into the jacket.

In one embodiment of the invention, the jockey jacket has a vest shape, such as shown in FIG. 4. In FIG. 4, the jacket 60 has series of mini-airbags 62 that are webbed within the material to provide support and to dissipate impact energies. Other air pockets 64 are much larger, to "spread" the effect of forces inflicted on the jockey's body 66. By analogy, the mini-airbags 62 are similar to "bubble-wrap," a common packing material used by manufacturers and carriers. A series of air conduits (not shown) provide a pressurization path to each of the mini-airbags 62 so that one or more pressure sources (not shown) can inflate the jacket 60 upon command. Likewise, the air-pockets 64 are also connected to the air conduits for pressurization on command. The pockets 64 are much larger than the mini-airbags 62 and act as a shield against impact energies. Specifically, the air pockets are pressured to provide a strong shielding against outside forces, and to diffuse a blow, such as a horse's hoof, over a greater area, reducing the chances of trauma and directed puncture. Accordingly, the pressure within the pockets 64 is substantially greater than the pressure within the mini-airbags 62, so that impact forces are dissipated and "spread-out" across the jockey's body 66. As such, blows to the jockey's body 66 are distributed to reduce the likelihood of localized and acute bodily injuries.

Figure 4A:
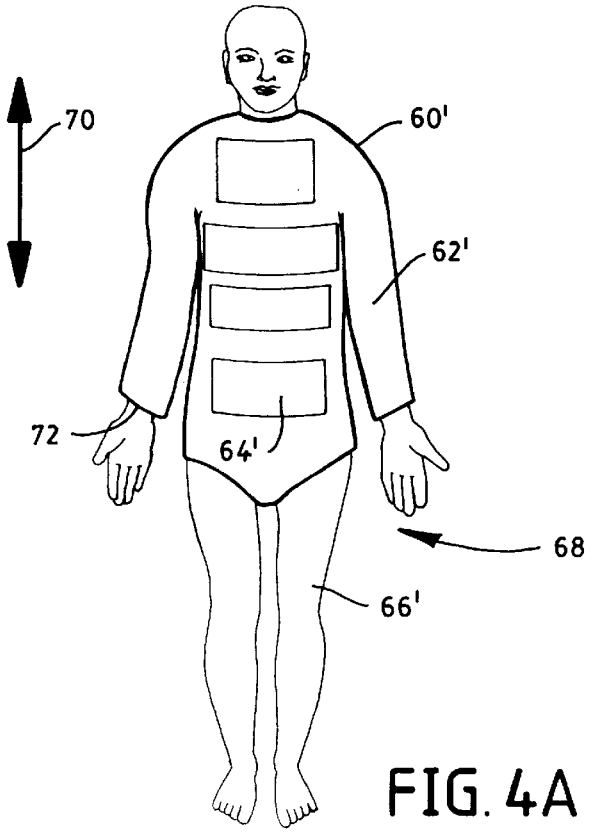

FIG. 4A illustrates an alternative form of the jockey jacket shown in FIG. 4. In particular, the jacket 60' of FIG. 4A is flexible and resembles a "jump suit." As such, the person wearing the jacket 60' steps into the jacket so that the several mini-airbags 62' substantially surround the entire spine, including that area around the hips and buttocks 68. Accordingly, the jacket 60' helps to minimize compression-type injuries, i.e., those injuries resulting from impact forces directed along the axis 70 of the spine. One air-pocket, for example, can surround the rider's buttocks to protect against these compression-type spinal injuries.

The jacket 60' of FIG. 4A is not altogether appropriate for jockeys riding a horse. Typically, the jockey—such as the jockey 20 of FIG. 1—wears the jacket under the riding silks; and the jacket sleeves 72 of FIG. 4A might create problems. However, those skilled in the art understand that the jacket of the invention is suitable for other activities, such as motorcycling. In such an activity, the sleeves 72 are not a hindrance and are more appropriate. Accordingly, the jacket 60 of FIG. 4 provides a more suitable shape for the jockey jacket.

The invention as described provides certain advantages. The jacket, as constructed according to the invention, weighs less than five pounds, and preferably less than or equal to two pounds. These small weights are important as weight is carefully assigned to jockeys and their mounts prior to the race; and the freedom to assign weight to a particular horse is essential.

In the preferred embodiment, there are a plurality of air pockets 64, 64', such as shown in FIGS. 4, 4A. Alternatively, a single air pocket can be utilized and which substantially covers the jockey's torso.

Figure 5:
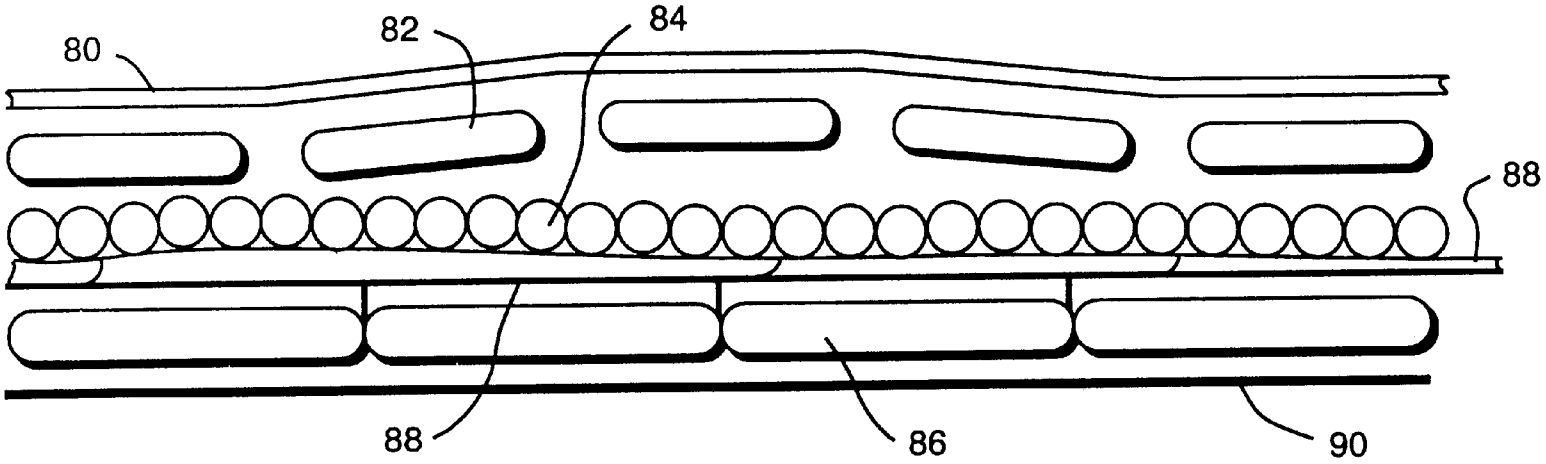
FIG. 5 illustrates a cross-sectional view of a jacket constructed according to the invention.

The jacket of the invention is formed of standard materials and specially woven fabrics to house the electro-mechanical and actuated components discussed herein. FIG. 5 shows, in a cross-sectional view, one embodiment of the invention whereby a plurality of layers form the jacket. Typically, the jacket provides an outer layer 80 of ballistic nylon and an inner dense padding of compression pads 82. A layer 84 of mini-airbags, shown with a bubble-wrap appearance, provides overall impact resistance and absorption of impact energies. The air-pockets 86, such as the pockets 64, 64' of FIGS. 4, 4A, are much larger than the mini-airbags of layer 84; and operate to dissipate forces evenly over the body. A series of air conduits 88 provide a pressurization path to the pockets 86 and the airbags in layer 84. The conduits are sufficiently large so as to provide an adequate air flow rate during actuation of the jacket within about 0.3 seconds. An inner layer 90 of ballistic nylon is the inner lining to the jacket.

Preferably, the airbags 82, 84 of FIG. 5 are sewn within and to the jacket material 80, 90. Further, other structure incorporated within the jacket of the invention, and as described in more detail below, is also sewn within and to this material. The durable ballistic nylon, for example, is particularly suitable for being threaded or tied to the airbags and other structure described below.

Those skilled in the art will appreciate that other or alternative jacket layering is possible within the scope of the invention. For example, additional layers of ballistic nylons between the outer and inner layers 80, 90 can be inserted within the jacket. Also, the ordering of the layers of FIG. 5 can be changed without departing from the scope of the invention. By way of a further example, the air pockets 86 can be inverted with the layer 84 of mini-airbags. This ordering is sometimes preferred by providing a more comfortable fit to the body once the jacket is actuated.

Other suitable jacket materials according to the invention include those materials utilized by the automobile industry in airbag construction, including: polyurethane, rubber with cloth covers, vinyl, poly and textiles that are heat sealed and sewn, steel reinforced, KEVLAR™, neoprene with KEVLAR™ aramid fiber reinforcement, polyethylene, polypropolene, MYLAR™(polyester), and acetate. One particularly suitable airbag design suitable for formulating the air pockets of the invention is found within U.S. Pat. No. 5,421,610, entitled "Inflatable Airbag," and is accordingly incorporated herein by reference. As described within this patent, the airbags include a tear seam and act to absorb more impact energies than other, non-tear seam technologies. This increased energy absorption is desirable in connection with the invention.

Other material technologies, air and gas sources, and actuation mechanisms are described in connection with existing U.S. patents, and are at times suitable for use with the invention, particularly in connection with the figures discussed below. For example, U.S. Pat. No. 4,089,065, entitled "Clothing for Providing Protection Against Forceful Impact," describes certain expandable and wear-resistant clothing and is accordingly incorporated herein by reference. The following patents provide other useful information and are also incorporated herein by reference: U.S. Pat. No. 4,637,074, entitled "Protective Garment;" U.S. Pat. No. 5,402,535 entitled "Restraining Neck Guard;" U.S. Pat. No. 3,827,716 entitled "Safety Vest;" U.S. Pat. No. 5,091,992 entitled "Motorcyclist's Air Strips;" U.S. Pat. No. 4,685,151 entitled "Motorcycle Safety Apparel;" U.S. Pat. No. 5,390, 367 entitled "Helmet and Shoulder Pads Having Inflatable Protective Means to Protect the Cervical Spine;" U.S. Pat. No. 5,133,084 entitled "Automatically Inflatable Collar Safety Device;" U.S. Pat. No. 5,394,563 entitled "Anti-Garment Fabric;" U.S. Pat. No. 5,335,884, entitled Adaptable Aircraft Airbag Protection Apparatus and Method;" U.S. Pat. No. 5,415,429, entitled "Pneumatic pressure-operated Vehicle Airbag;"

The plurality of mini-airbags illustrated in FIGS. 4, 4A, and 5 provide overall protection of the jockey's body. Together with the larger air pockets 68, 68', FIGS. 4, 4A, the airbags inflate at selected pressures and frequencies to absorb the multitude of forces realized by the jockey. One or more gas sources, such as $CO_2$ cartridges, are actuated on command to pump air or other gas to within the airbags and pockets by sensor and control electronics discussed in more detail below. This pressurization must occur rapidly, and while the jockey is in the air. Further, the pressurization must be maintained, or controlled, such as described in connection with FIGS. 3, 3A, 3B, during the period within which injury is expected. This period is not expected to last longer than five seconds; and the invention thus provides for releasing excess air after about five seconds so that the person wearing the jacket is not unnecessarily constrained after the fall.

Figure 6:
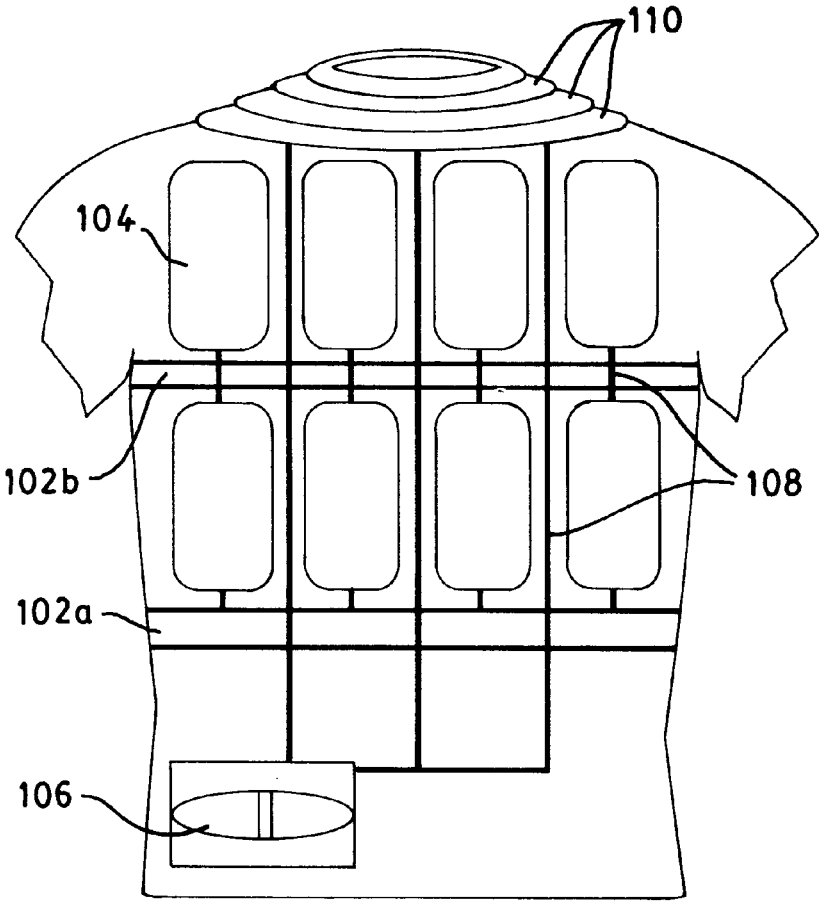
FIGS. 6 illustrates another embodiment of a jacket constructed according to the invention.

The airbags of the invention are generally tied or connected to one or more central air supplies, e.g., gas generators. FIG. 6 illustrates one jacket 100 constructed according to the invention and which includes manifolds 102*a*, 102*b*, and a plurality of air pockets 104, e.g., similar to the air-pockets 64, 64' of FIGS. 4, 4A. A gas generator 106, e.g., a $CO_2$ cartridge or gas-generating pellet, provides the overall air supply to the jacket 100, and is actuated upon certain events. The air conduits 108 provide pressurization paths to each of the pockets 104, as well as to the mini-airbags (not shown in FIG. 6 for purposes of illustration).

FIG. 6 also shows one embodiment of the invention which includes a series of concentric and circular air cylinders 110. Like the air pockets 104, the cylinders 110 are pumped with air by the generator 106. Upon actuation, they extend upwards around the person's neck to provide resistance against sideways movement, thereby protecting the cervical spinal region.

Figure 6A:
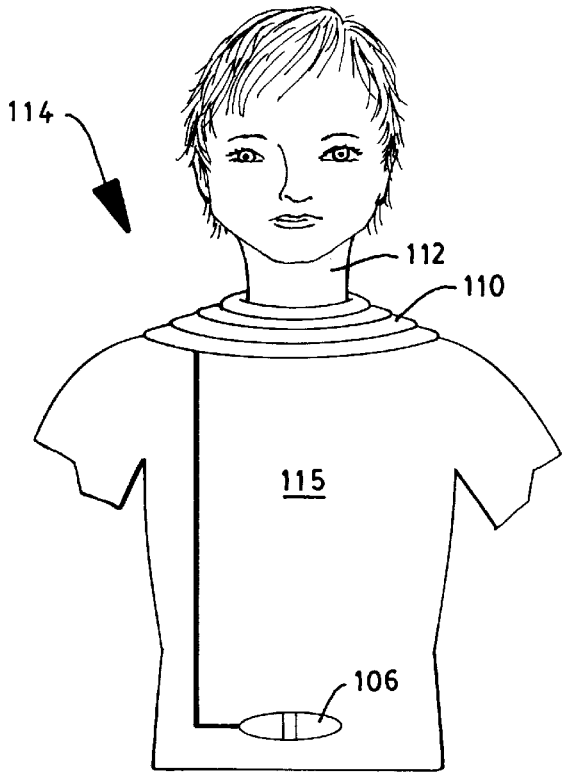
FIGS. 6A and 6B illustrate further operational aspects of the jacket of FIG. 6, and FIGS. 6C and 6D show additional functionality of the circular cylinders around the neck area of the jacket of FIG. 6.
Figure 6B:
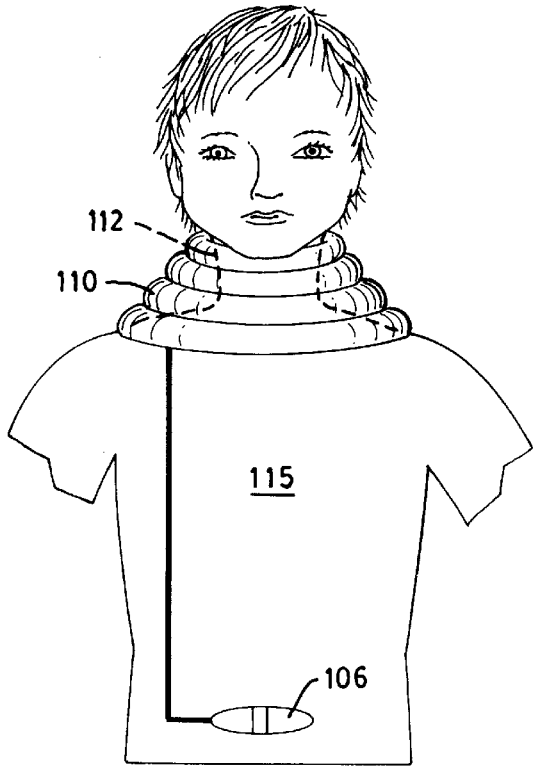

FIGS. 6A and 6B more fully illustrate the operation of the circular cylinders 110 of FIG. 6. As above, a gas generator 106 provides the overall air supply to the several air pockets, mini-airbags and circular cylinders 110, which specifically protect the persons' neck 112. As illustrated, FIG. 6A shows an un-inflated case where the circular cylinders are substantially flat against the top portion 114 of the jacket 115. However, upon actuation, such as shown in FIG. 6B, the gas generator 106 pumps air or gas into the cylinders 110 and the cylinders 110 expand upwardly around the neck 112, providing protection against shearing and torque-like forces.

Figure 6C:
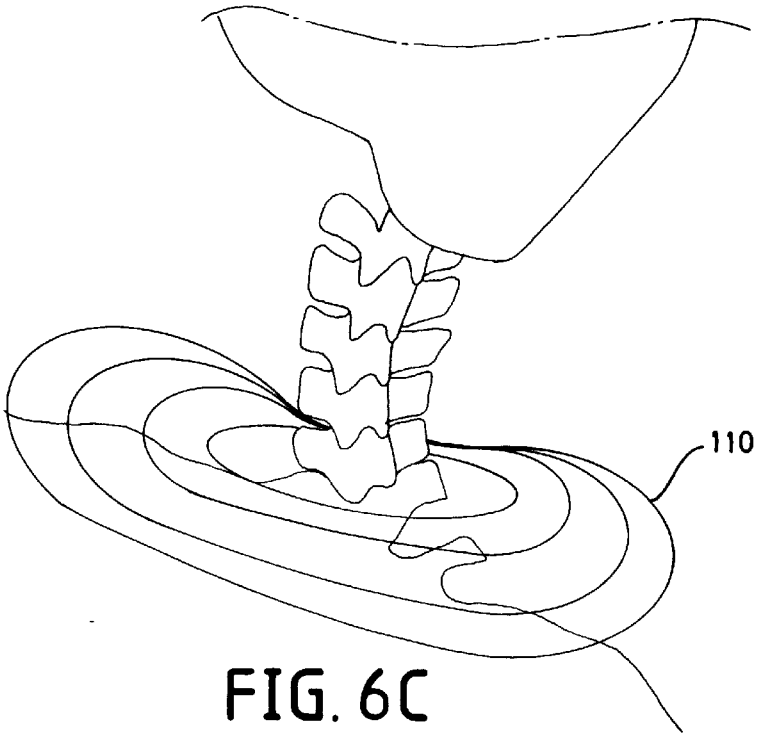
Figure 6D:
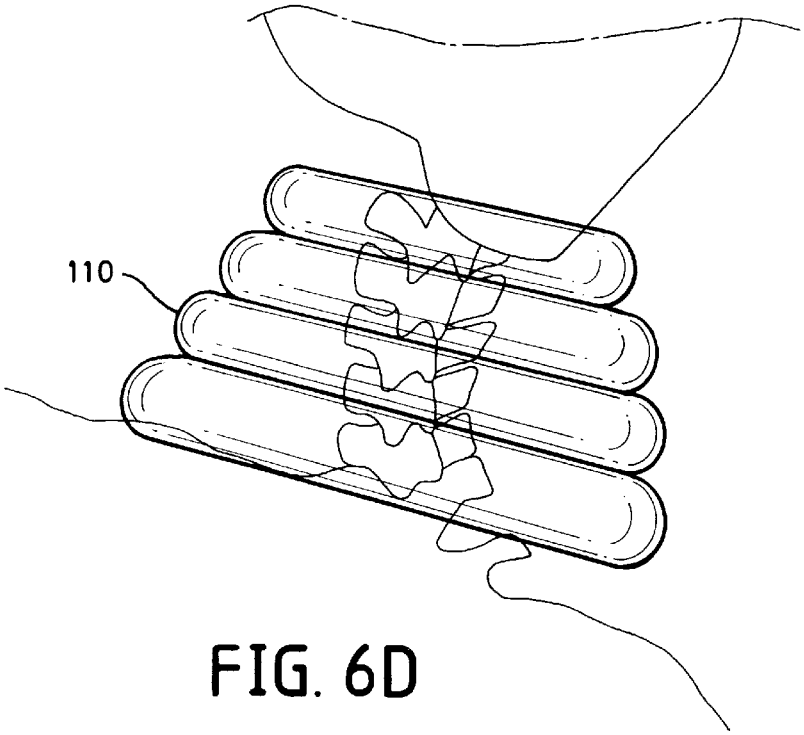

FIGS. 6C and 6D show further features of the circular cylinders 110 by illustrating the cylinders 110 around a human's cervical column and in a "see-through" configuration. FIG. 6C, in particular, shows the cylinders 110 in an un-inflated mode; while FIG. 6D shows the cylinders 110 in an inflated mode. The cylinders appear donut-shaped when inflated, where each of the cylinders has a different radius, with the largest radial cylinder nearest to the person's collar-bone, and with the smallest radial cylinder nearest the person's head and chin. This provides a sturdier platform against motions such as the shearing motions experienced by jockeys during a fall. The pyramid-like array of cylinders provide a symmetrical resistance along an axis that extends outwardly from the concentric axis along the spine. By way of comparison, a column of equally-sized cylinders provides less force resistance along the outward axes as compared to the illustrated approach.

Figure 7:
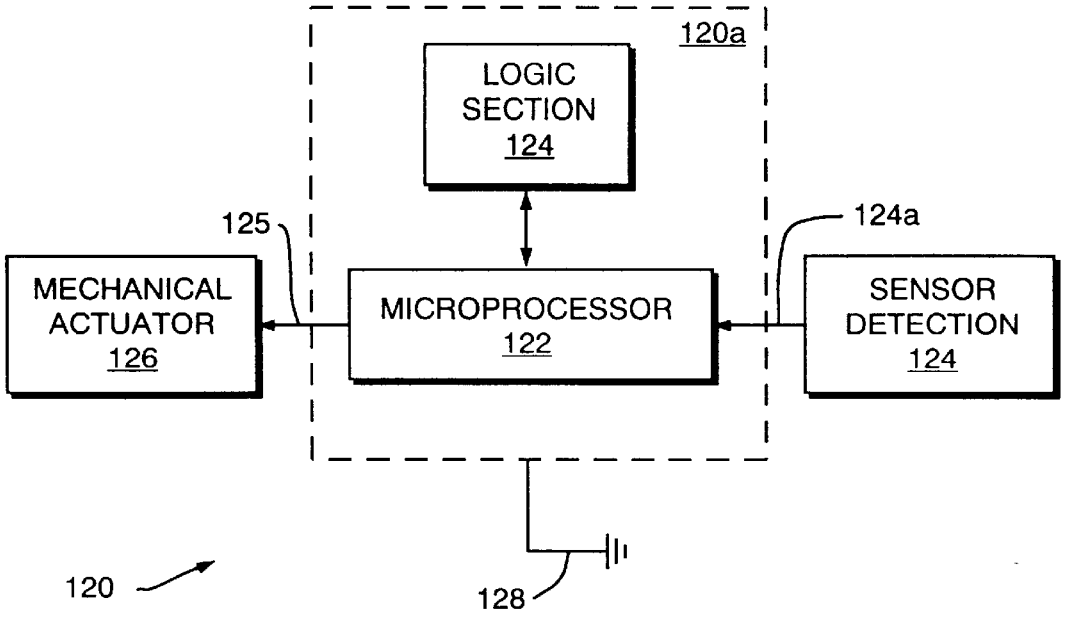
FIGS. 7 and 7A schematically show circuitry, constructed according to the invention, that controls pressurization of airbags within a jacket such as shown in FIG. 6.
Figure 7A:
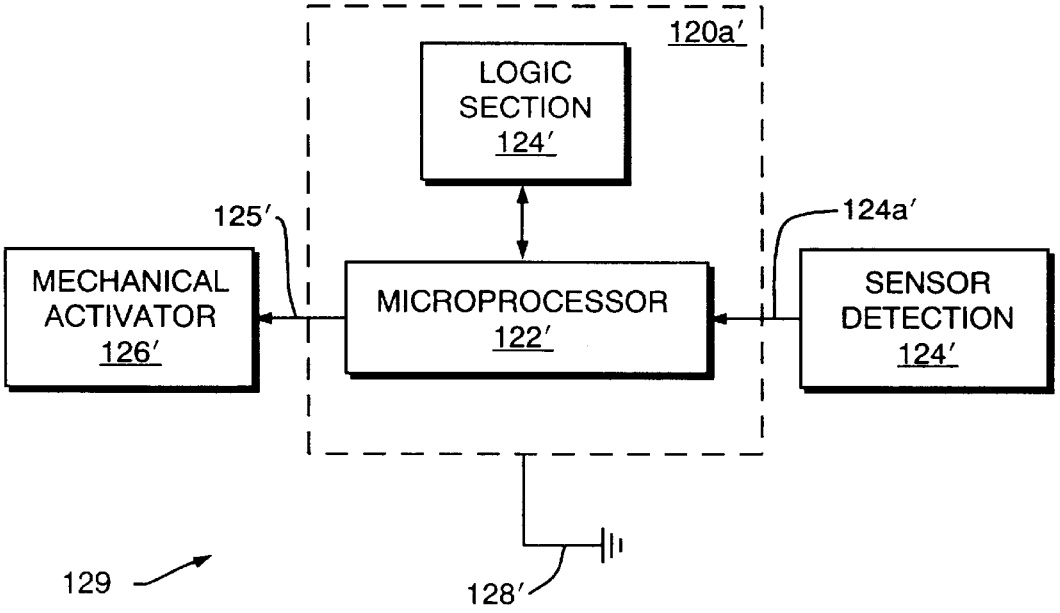

As described in connection with FIGS. 3–3C, the air pockets 104 and cylinders 110 of FIGS. 6–6B are preferably pressurized with a feedback loop (i.e., control circuitry) to control the pressures within the airbag or cylinder according to the non-linear decelerations experienced by the rider during the fall. FIGS. 7 and 7A illustrate control circuitry which controls the air pressurization within the airbags and cylinders 104, 110 of FIGS. 6–6B and such as described in connection with FIGS. 3–3C. The control circuitry operates to dampen the body's deceleration such that impact energies are absorbed and reactive bounces are minimized.

More particularly, FIG. 7 illustrates a control circuit 120 which controls the air flow into an airbag as described herein, such as the airbag 34 of FIG. 3. The circuitry 120 includes a microprocessor 122 that is connected to a logic section 124. The logic section 124 provides the logic flow for determining when and how to actuate the gas generator 106, such as through a pressure valve 40 of FIGS. 3A, 3B.

A sensor 124 provides a signal of the pressure within the airbag, and transmits that signal through signal line 124*a* to the microprocessor 122. By way of example, the sensor 124 is similar to the pressure sensor 38 of FIG. 3, and the signal line 124*a* is similar to the signal line 38*a*. When the microprocessor 122 detects a pressure signal corresponding to a selected deceleration pressure, the logic section 124 determines that air should be pumped into the airbag, and the microprocessor 122 generates a signal, through signal line 125, to command the pumping of additional gas into the airbag through operation of the mechanical actuator 126. By way of example, the mechanical actuator 126 can be the pressure valve 40 described in connection with FIG. 3A, and is thus responsible for gating the flow of air into the airbag as commanded by the microprocessor 122.

The circuitry 120 is preferably packaged within a single integrated circuit (IC) 120*a*, and is powered by a battery 128. This IC is then easily packaged within a protective structure and sewn within the jacket such that the battery is accessible for easy replacement.

FIG. 7A similarly shows control circuitry 129 for releasing pressure from an airbag, such as the airbag 104 and cylinders 110 of FIGS. 6–6B, in a controlled manner so as to dampen and stop a body's impact against the airbag smoothly, depending upon the energies absorbed by the airbag. As above, a logic section 124' controls the logic of the microprocessor 122' which receives sensor signals from a pressure sensor 124' and through signal line 124*a*'. When the pressure signal reaches a preselected value or range of values, the microprocessor 122' generates an activation signal through signal line 125' to actuate the mechanical actuator 126'. The actuator 126' is, for example, similar to the pressure release valve 40' of FIG. 3C, which facilitates air flow control through the voltages applied across the piezo-crystal 42*a*', 42*b*'.

Figure 7B:
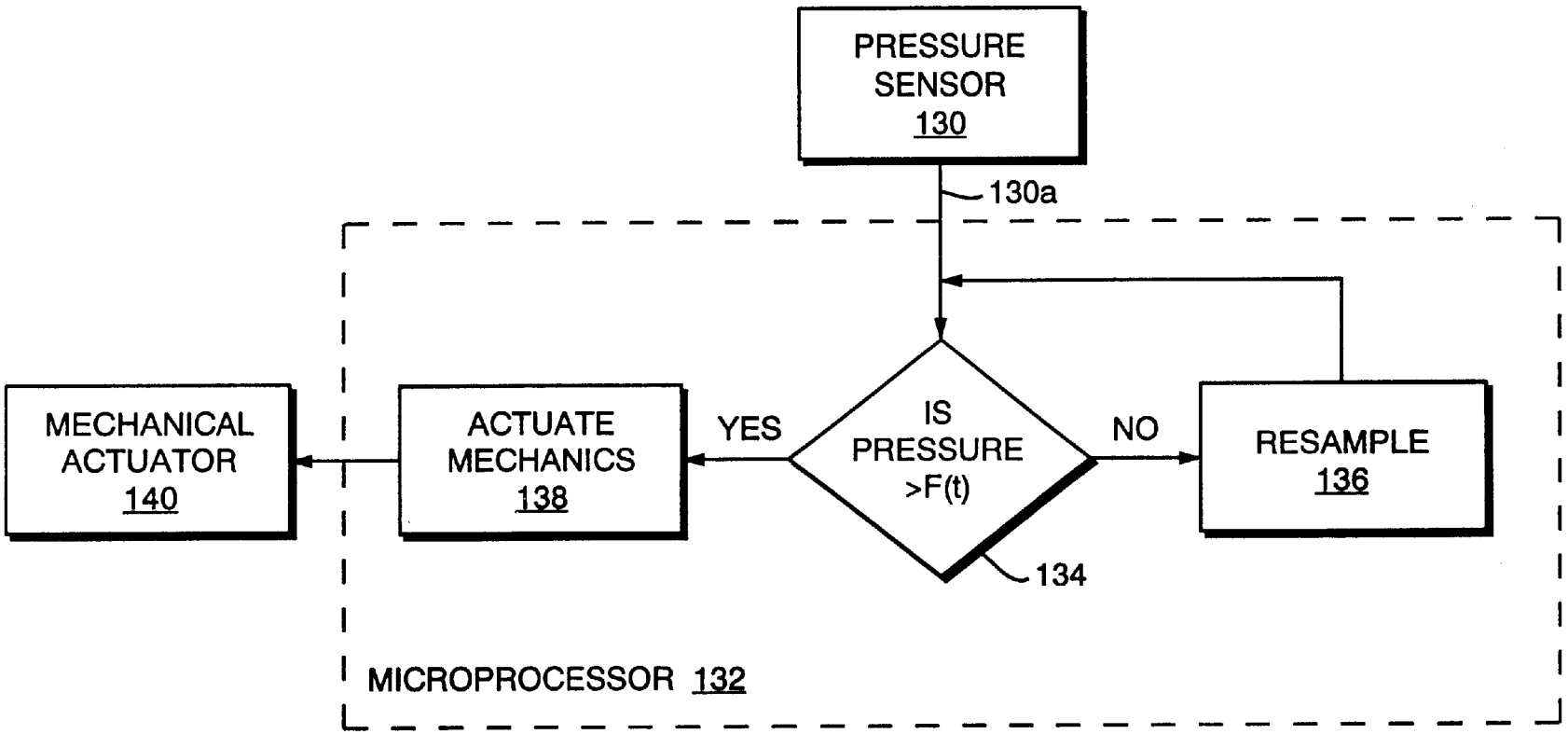
FIG. 7B illustrates selected logic flow and IC structure for use with circuitry of FIGS. 7 and 7A.

FIG. 7B illustrates circuitry and associated control logic flow 128 that is suitable for encoding into the logic sections 124, 124' and microprocessors 122, 122' of FIGS. 7 and 7A. A pressure sensor 130, e.g., the sensor 38 of FIG. 3, connects to the integrated circuit 132 and transmits signals continuously into the IC 132 along signal line 130*a*. The update rate of the pressure signal must be sufficient to make a decision to actuate the jacket within about 0.030 s, and should therefore be greater than about 200 Hz. The IC 132 can convert the signal on signal line 130*a* into a digital signal in the event that sensor 130 provides an analog signal; but a digital pressure sensor is preferred, whereby a digital update of the pressure is provided at the 200 Hz rate.

In logic element 134, the IC 132 determines whether the pressure signal is above a preselected value, denoted as F(t), which can be a constant, but preferably is a function that varies with time. When the function F(t) varies over time, e.g., the time since actuation, the function's magnitude varies non-linearly with time so that a damping factor is injected into the airbag pressurization. For example, the damping factor F(t) is used to control the air injected into the airbag, such as described in connection with FIGS. 3A, 3B, and/or the air expended from the airbag, such as described in connection with FIG. 3C. This damping factor generally operates to decelerate the body impacting the airbag in a smooth fashion and until the body stops motion.

If the pressure signal does not exceed the function F(t), the IC 132 resamples, in logic element 136, the signal from the sensor 130, preferably at a rate that captures the 200 Hz update rate. If, however, the pressure exceeds F(t), the IC 132 commands, through logic element 138, the actuation of the mechanical valve 140, e.g., the valves 40, 40' of FIGS. 3–3B and 3C.

Figure 8:
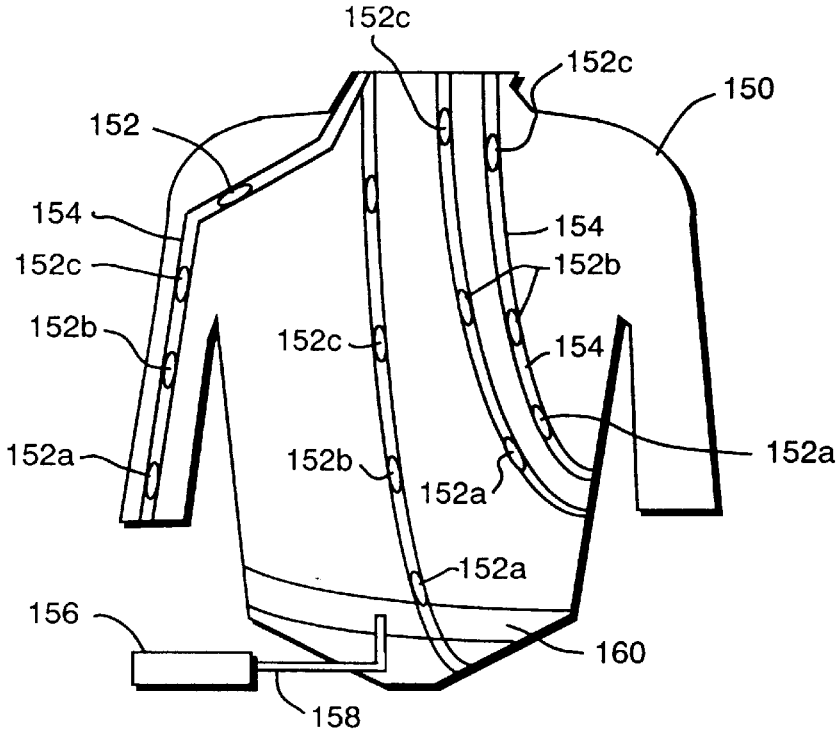
FIG. 8 schematically illustrates a jacket, constructed according to the invention, which includes a series of tracks and caps lined within the jacket to provide an exo-skeleton upon actuation of the jacket.

The invention also provides a mechanically actuated exo-skeleton. FIG. 8 illustrates one jacket 150 constructed according to the invention whereby a series of telescopically aligned cap-elements 152 (hereinafter "caps") are disposed along a series of substantially vertically aligned tracks 154. In a preferred aspect of the invention, each of the tracks 154 also functions as an air conduit, such as the conduit 88 of FIG. 5 or 108 of FIG. 6. These vertically-aligned tracks 154 are preferably tubular, to facilitate movement of the caps 152 Within the track, as well as flexible, to facilitate the person's movement within the jacket. The tracks 154 are knitted into the jacket fabric, such as described in connection with FIG. 5.

The tracks 154 thus have three purposes: first, they provide an air conduit to the several airbags within the jacket; secondly, they provide some physical strength in exo-skeletal form because the expand slightly with air, become stiff; and lastly, they act as a conduit for the telescopic caps 152.

Figure 8A:
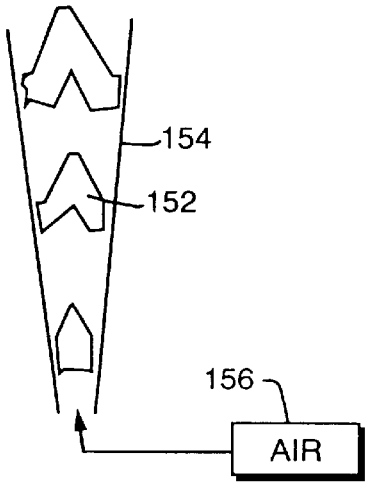
FIGS. 8A and 8B illustrate selected operational detail of the caps and tracks of FIG. 8, particularly in the formation of a column made up of a plurality of caps.
Figure 8B:
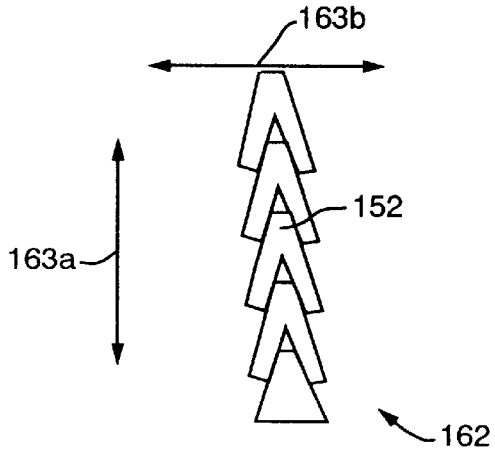

Each of the caps 152 slides loosely within the associated track 154. The track length and cap size differ along the length of the track, such as shown in FIG. 8A (note that the FIG. 8 is exaggerated for purposes of illustration), so that the caps 152 are spread out during normal use and are distributed evenly along the length of the track 154. When the gas generator 156 is commanded to release gas into the manifold 160, via conduit 158, the lowest cap 152*a* of each track 154 slams upwards and connects into the cap 152*b* immediately above it; and those two caps 152*a*, 152*b* likewise travel upwards to connect with the next cap 152*c*, and so on. Collectively, the caps make a rigid metal column, such as shown in FIG. 8B.

Thus, in accord with the invention, when the jacket 150 actuates, the bottom-most cap 152*a* slams upwards and creates a chain reaction that connects one cap to the next. The resulting column structure 162, FIG. 8B, provides rigidity, particularly along the longitudinal axis 163*a* and transverse axis 163*b*. The caps 152 illustrated in connection with FIGS. 8 and 8A are spread out to facilitate bending within the normal, unactuated jacket 150. Accordingly, the caps 152 within the jacket 150 are relatively unnoticeable to a user until the jacket 150 actuates. A user might, however, hear the caps 152 moving along the length of the track 154, generating a sound like beads connected on a string. Such noises will vary depending upon jacket and cap materials.

Preferably, the caps 152 remain free from one another during normal, unactuated operation of the jacket 150. To prevent the caps 152 from sticking together, a small blocking element can be used on the lower aperture of each cap. One such blocking element is a soft polyethylene material, e.g, Handi-Wrap™; and the strength of the blocking element is low such that it breaks once the jacket 150 is actuated. Another blocking element is a break-off tab, such as illustrated in FIG. 8C.

Figure 8E:
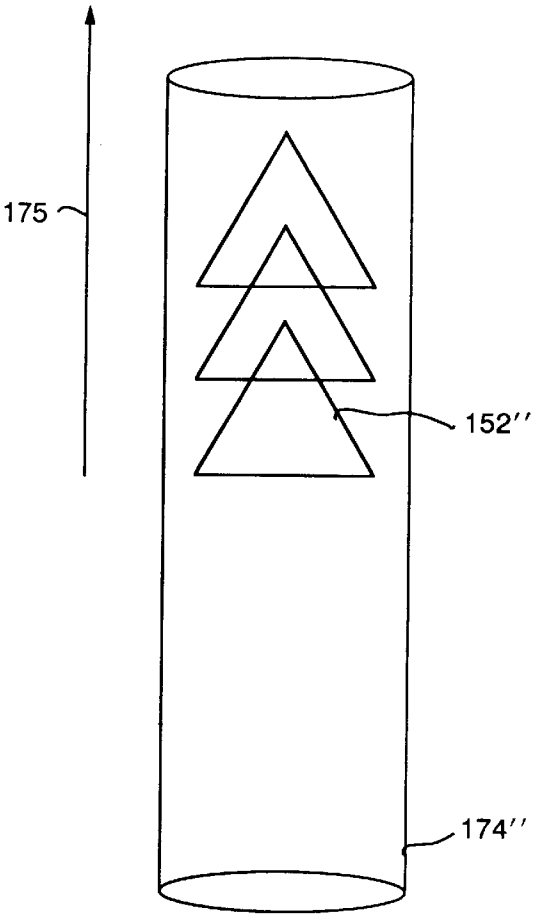
FIGS. 8D and 8E illustrate operational behavior of the caps within the tracks upon actuation of the jacket of the invention.
Figure 8D:
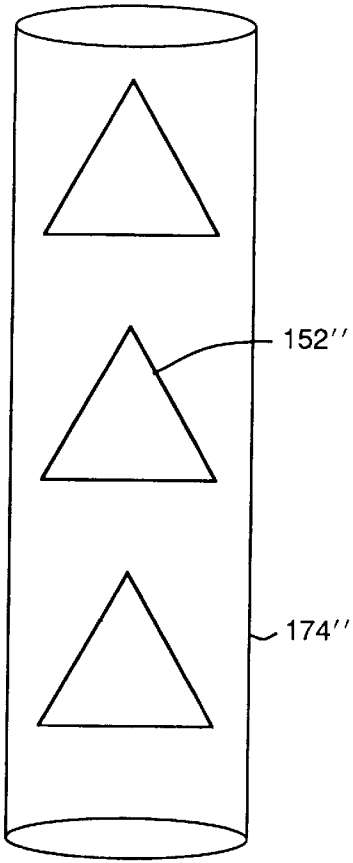
Figure 8C:
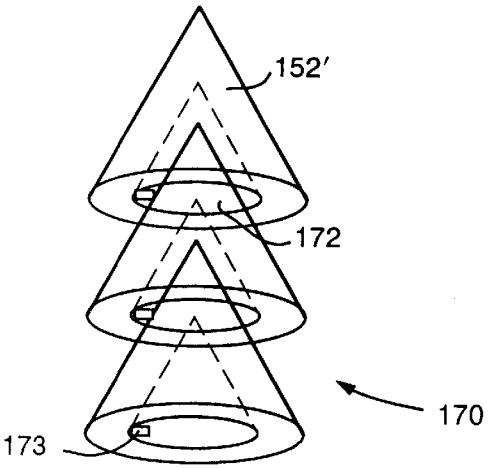
FIG. 8C shows a representative column of caps, interconnected within one another, in accord with the invention.

FIG. 8C shows a perspective view of a column 170 that is formed by the connection of a series of caps 152' (note that the column 170 is shown with transparent caps 152', for purposes of illustration). The aperture 172 of each cap 152' is the entrance port for the cap below upon actuation of the jacket. A blocking element 173 is a tab that prevents each adjacent cap from entering the aperture 172 unless the jacket actuates, which generates enough force to pass the cap through the aperture 172.

The caps 152, 152' of FIGS. 8–8C are made from lightweight and strong materials such as plastics, composite materials, and aluminum. The blocking elements, e.g., element 173 and the Handi-Wrap™ material, also function to reduce the noise of the caps 152.

The force of air generated by the gas generator, e.g., the generator 156, FIG. 8, forces the caps upwards, interconnecting the caps along the length of the track. FIGS. 8D, 8 E illustrate this operation in more detail. In FIG. 8D, the caps 152" are loosely arranged within the track 174". Upon actuation, the air generated upwards, i.e., in a direction 175, along the track 174" forces the caps 152" together and upwards, such as shown in FIG. 8E.

Figure 9:
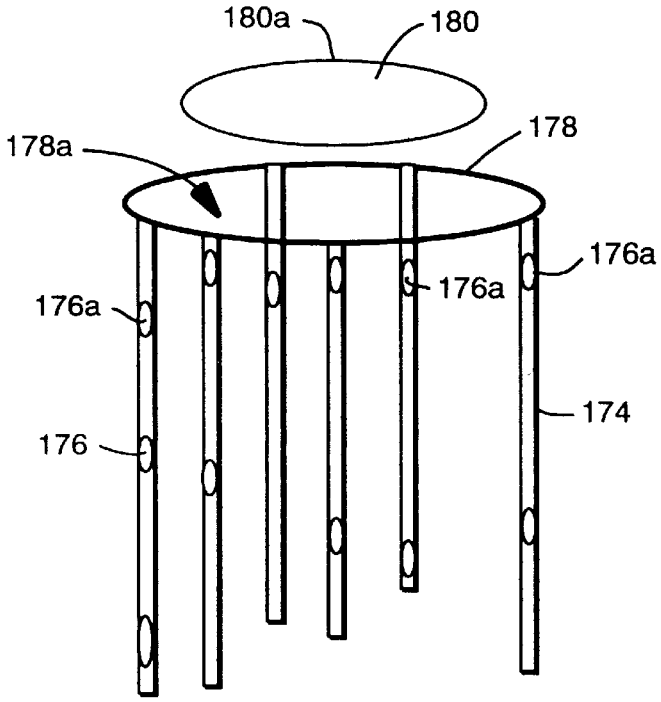
FIGS. 9 and 9A show, respectively, the internal operation of an unactuated and actuated jacket, constructed according to the invention, and which demonstrates the functioning of a plurality of tracks and caps within the jacket.
Figure 9A:
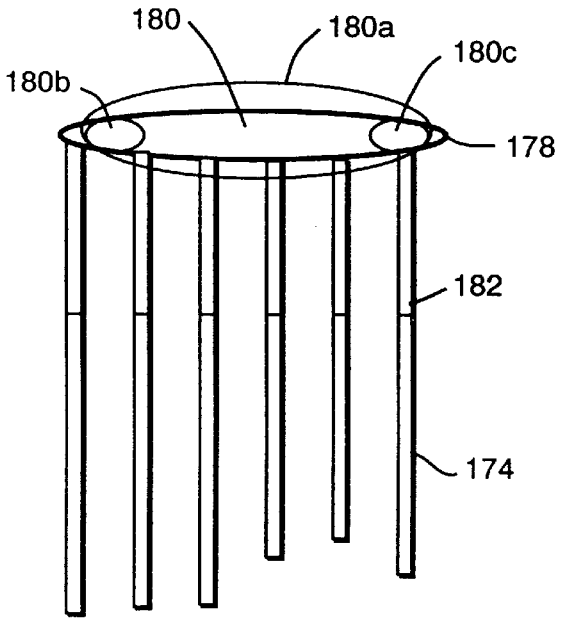

The integrated cap structure provides an exo-skeleton around the jockey's head, such as illustrated in FIGS. 9 and 9A. Note that FIGS. 9, 9A are provided for illustrative purposes only, and without the curvatures normally expected within a jacket. Normally, for example, each of the tracks 174 for the caps 176 are curved within the jacket, rather than as straight tubes as shown in FIG. 9. Also, of course, the tubes and caps are not readily visible through the jacket, unless the jacket is physically cut open.

FIG. 9 illustrates the structure of the tracks 174 and caps 176, according to the invention, in a normal, unactuated mode. FIG. 9A, on the other hand, shows the tracks 174 and caps 176 in an actuated mode, i.e., the mode whereby the jacket of the invention has detected a fall and has commanded the jacket actuation, resulting, in part, with the formation of the columns, such as the column 162, FIG. 8B.

With specific reference to FIG. 9, a thin but very strong connect structure 178 is tied into the collar of the jacket to provide an "end point" for the upper-most cap 176*a*. The jockey's head 180 is illustrated near to the connect structure 178 such that—as the jacket is actuated—the resulting forces generated by the columns 182, FIG. 9A, push the structure 178 up and snugly around the head 180. More particularly, the collar (not illustrated, for purposes of clarity) surrounding the structure 178 is forced upwards, during jacket actuation, to rest against the sturdy portions of the head: the chin 180*b* and the back of the skull 180*c*. The body 180 is not injured by the structure 178 during actuation and the fall because the inside 178*a* of the structure 178 is padded with a series of air-pockets and/or mini-airbags (not shown in FIGS. 9, 9A), such as described in connection with FIGS. 3 and 6, to cushion the fall forces around the neck and head region.

Alternatively, the collar and structure 178 of FIGS. 9, 9A extend upwards and over the head 180, which provide even better protection for the user since the top of the skull 180*a* is physically protected by the structure 178. In such a case, the person wearing the jacket may be temporarily blinded, unless the materials utilized within the jacket are formed of transparent or semi-transparent materials, e.g., see-through plastics.

Figure 10:
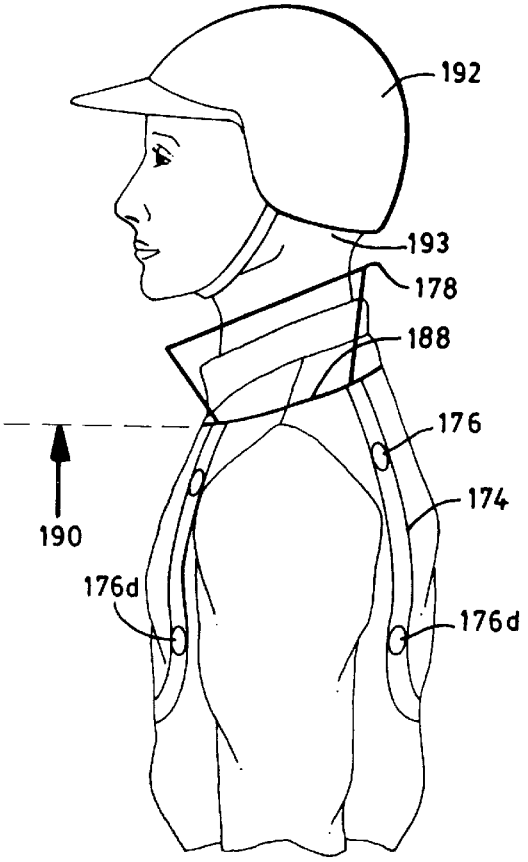
FIGS. 10 and 10A show further operational aspects of the internal structure of a jacket constructed according to the invention.
Figure 10A:
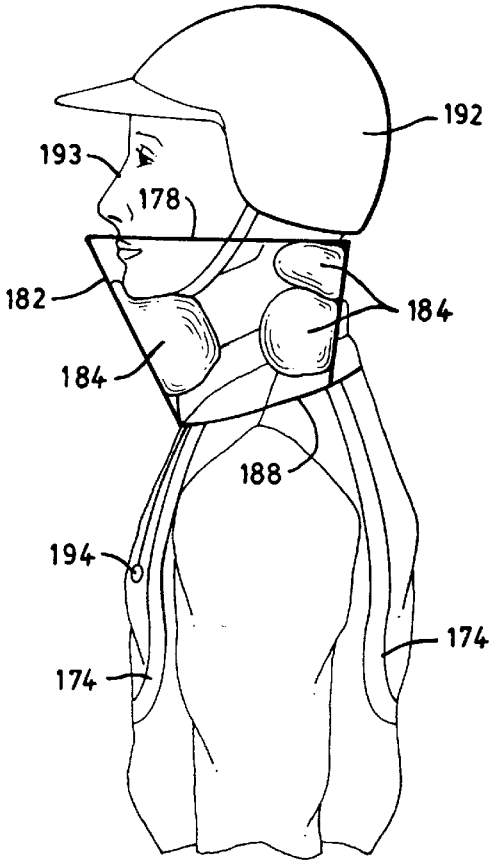

FIGS. 10 and 10A illustrate further detail of the invention described in connection with FIGS. 9, 9A, particularly with respect to the padding within the collar structure 178. FIG. 10 shows the normal, unactuated operation and position of the track 174, caps 176, and collar structure 178; while FIG. 10A illustrates the actuated operation of the elements 174, 176 and 178, as well as the resulting column 182 (made up of a series of caps 176) and the padding 184. The base 186 of the column 182 connects into a base webbing 188—described in more detail in connection with FIG. 10B—once the jacket is actuated to provide a secure anchor for each column 182. The base webbing 188 thus provides a vertical support for each column 182 once the lower-most cap 176*d*, FIG. 10, passes the height 190 of the webbing 188 within the jacket. A helmet 192, known to those skilled in the art, protects the jockey's head 193.

The webbing 188 can be removed by pulling the web-access 194, and withdrawing the length of the webbing out of the jacket. This releases the several columns anchored onto the webbing 188 so that the columns 182 fall apart into separate caps 176. Accordingly, the web-access 194 releases the jacket from its actuated position, and disengages the exo-skeleton formed by the several columns 182 and structure 78. The web-access 194 has a small ring that is visible and accessible to a person outside the jacket, who hooks the ring with his finger and pulls, thereby removing the webbing and the cap structures are released. Once removed, the jacket is no longer useful without reconfiguration. To circumvent this, a series of webbings 188 can be within the jacket, whereby the jacket can be reconfigured quickly—by removing one webbing after each actuation—and until all the webbings are removed.

The collar structure 178 is typically braced against chin and back of skull, such as shown in FIG. 10A. Representative airbags 184 provide a cushion against the structure 178 so that the jockey does not injure herself by this apparatus during actuation and/or during impact, particularly at the contact points such as the chin and skull. Accordingly, the airbags 184 are preferably pumped up prior to the full formation of the several columns 182, since the force of those columns will tend to force the jockey's head into a straight-up position; and this force is smoothly applied provided there is sufficient cushioning through the airbags 184.

Figure 10B:
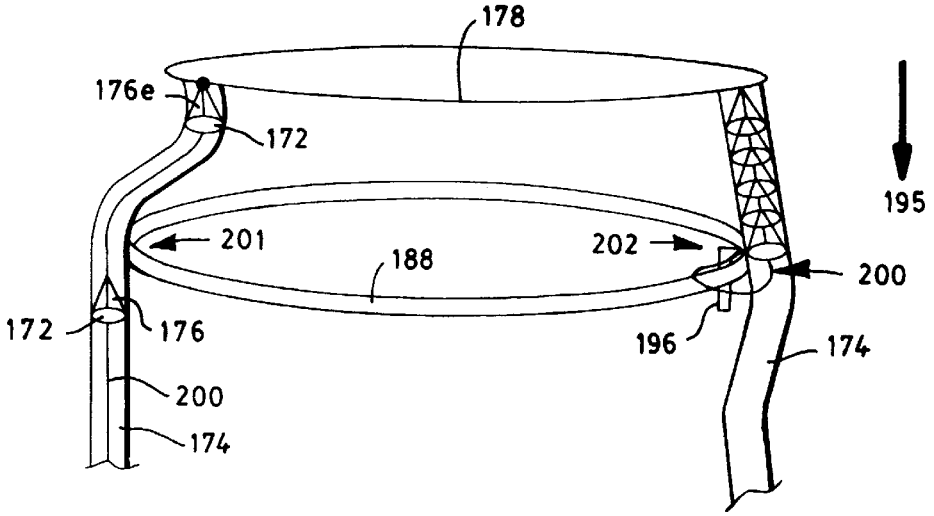
FIG. 10B illustrates additional detail of a column constructed from a series of caps, in accord with the invention, and which is connected to a base webbing within the jacket to provide a foundation for the resulting exo-skeleton.

The webbing 188 is made from a sturdy flexible member, such as strip steel, which is tightly woven into the material of the jacket. When the gas generator actuates the airbags and caps, the caps accelerate upwards and the bottom-most cap hooks over the base webbing 188, holding it and the other caps firmly in the "up" position. FIG. 10B illustrates this operation in more detail. Note that for illustrative purposes, the right side of FIG. 10B shows a fully actuated column 182, while the left side shows loosely arranged caps 176 within the track 174 (connected to the webbing 188 at area 201) which corresponds to the nominal, unactuated jacket structure.

FIG. 10B illustrates the base webbing 188, the connected caps 176, and the collar structure 178, each of which is shown in connection with FIGS. 9, 9A, 10, 10A. The lower-most cap 176*d* has a lip 196 which hooks over the webbing 188 so that that cap 176*d* is anchored and so that any downward movement along the axial direction 195 of the column 182 is resisted by the anchoring. This resistance, of course, provides the protection for the jockey, because axial impacts along the axis 195 are absorbed, at least in part, by the columns 182 anchored to the webbing 188 (that is sewn within the jacket).

Preferably, the uppermost cap 176*e* is connected directly to the structure 178, such as illustrated by the cap 176*e* at the left side of FIG. 10B. That cap 176*e* is hinged to the structure 178 via a hinge 198. This hinged cap 176*e* has a very practical function: it provides the upper-most orifice for the caps 176 which are accelerated upwards and into the column 182 formation. The aperture 172, such as described in FIG. 8C, is relatively easy to connect into, as compared to connecting directly to the structure 178 during actuation. Accordingly, once the caps are actuated, they accelerate upwards, and each accelerated cap 176 has the goal of penetrating the aperture 172 of the cap immediately above. With the invention, this goal is achieved through co-alignment of the caps within the tracks 174, and also through the relatively fixed cap 176*e* anchored to the structure 178.

FIG. 10B also illustrates a string 200 that is used to tighten the column 182 after actuation. In particular, the string 200 is used to provide resistance along the direction opposite to the axial direction 195. By tying the string 200 tightly to the base webbing 188, such as shown in area 202, and once the lower-most cap 176*d* anchors there, the column 182 resists being pulled apart. This facilitates a two-directional resistance which strengthens the exo-skeletal features of the jacket.

By analogy, a bar-room stool is very sturdy against forces applied downwards onto the stool; but it is relatively unstable for forces applied to the sides or to underneath the stool. However, by gluing the stool to the floor, the stool resists motion in nearly all directions. The first downward force is similarly resisted by the column 182 once it is connected to the webbing 188. The string 200, on the other hand, resists the other forces opposite to this direction; and, like the stool analogy, the anchored and tied column 182 resists motion in several axes, providing greater overall protection to the jockey wearing the jacket of the invention.

Figure 11:
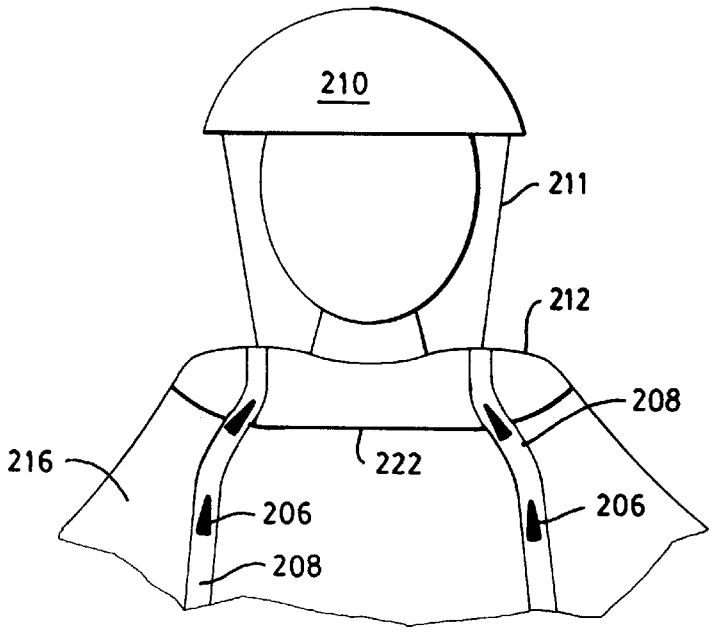
FIGS. 11 and 11A show another embodiment of a jacket, constructed according to the invention, which connects integrally with the jockey's helmet during actuation.
Figure 11A:
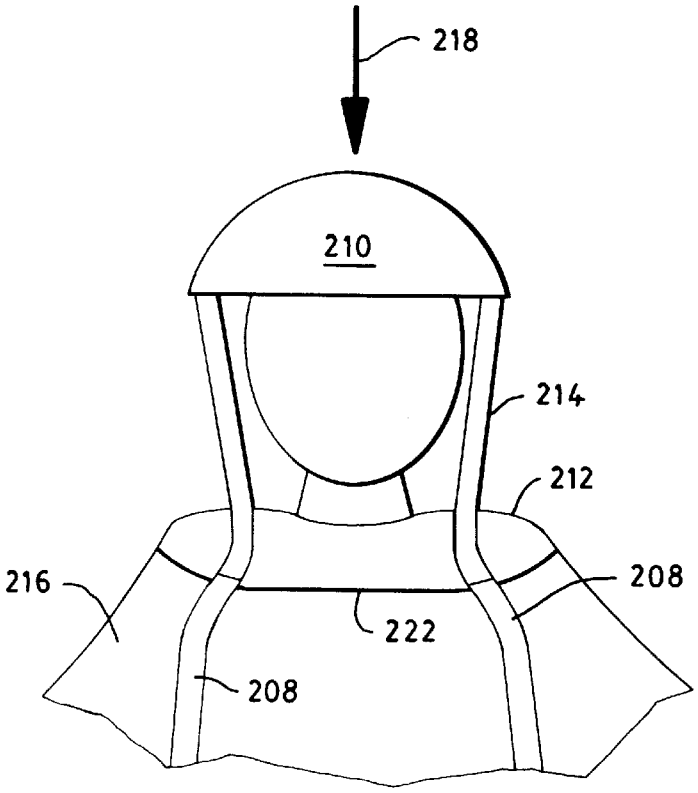

FIGS. 11 and 11A illustrate another embodiment of the invention whereby the caps 206 are connected through a track 208 connected to the jockey's helmet 210, such as along the helmet strap 211. Specifically, FIG. 11 shows the unactuated jacket 212 where the caps are loosely arranged along the length of the tracks 208. FIG. 11A, on the other hand, shows the jacket 212 in an actuated position, such that the columns 214 connect along the strap length and into the helmet 210, thereby forming a rigid exo-frame to protect the jockey 216. Forces 218 incident on the jockey's head are thus transferred to the body, such as around the chest and shoulder area 220, where the base webbing 222 connects to the columns 214.

The column 214 of FIG. 11A connects to the helmet 210 through a track attached such as through a plate or screw into the helmet 210. The track is loosely attached to the helmet strap under normal, unactuated conditions, and guides the caps within to attach to the helmet during actuation. Although only two columns 214 are illustrated in FIG. 11A, those skilled in the art will appreciated that additional columns can attach to the helmet in a similar manner. Preferably, the area adjacent to the jockey's trachea and throat are free of columns, to reduce risk.

The invention provides for several ways of sensing when the jockey leaves the horse on a terminal trip to the ground. Preferably, one or more sensors are proximity sensors, and are resident within, or are connected to, the jacket. The sensors connect to the microprocessor described herein to actuate the jacket upon the occurrence of certain events.

Figure 12:
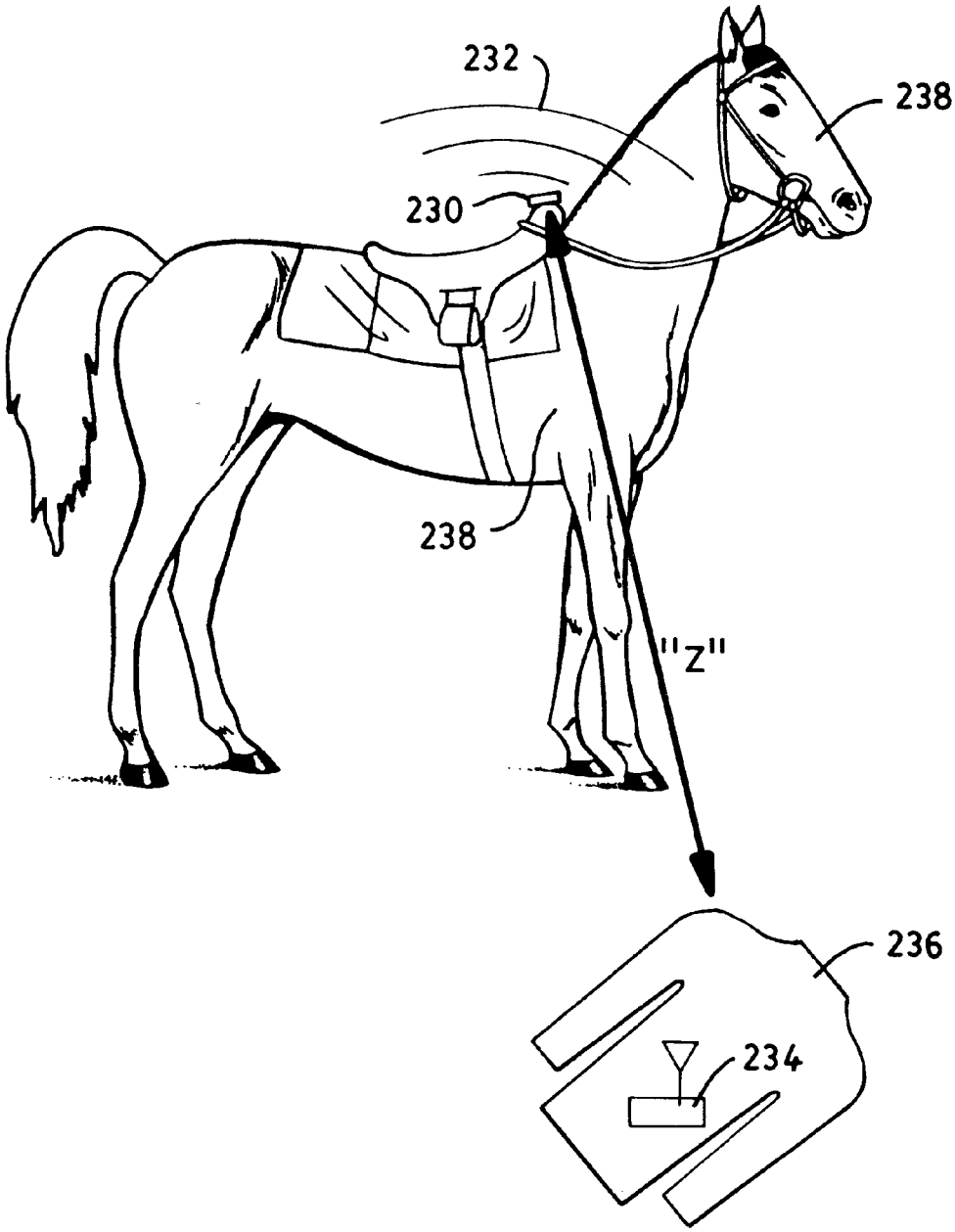
FIGS. 12, 12A and 12B illustrate sensor detect and actuation mechanisms, constructed according to the invention, for actuating the jacket upon certain events.

One suitable proximity sensor, for example, is known to those skilled in the art as a detection system which senses the distance to a calibrated source by the expected energy fall-off of 1/R^2, where R is the range to the source. By way of example, a variety of prisoner detect systems utilizing such proximity sensors are known and widely used in the art. In this embodiment of the invention, for example, the source is mounted with the horse, and the sensor Within the jacket, such as shown in FIG. 12. The source 230 emits radiation 232 which is calibrated to a sensor 234 resident within the jacket 236, e.g., a jacket such as described herein and constructed according to the invention. Once activated, such as described herein, the sensor 234 detects that the rider has fallen a certain distance "Z" from the horse 238, and communicates this "event" to the microprocessor, described below, which actuates the jacket 234.

Figure 12A:
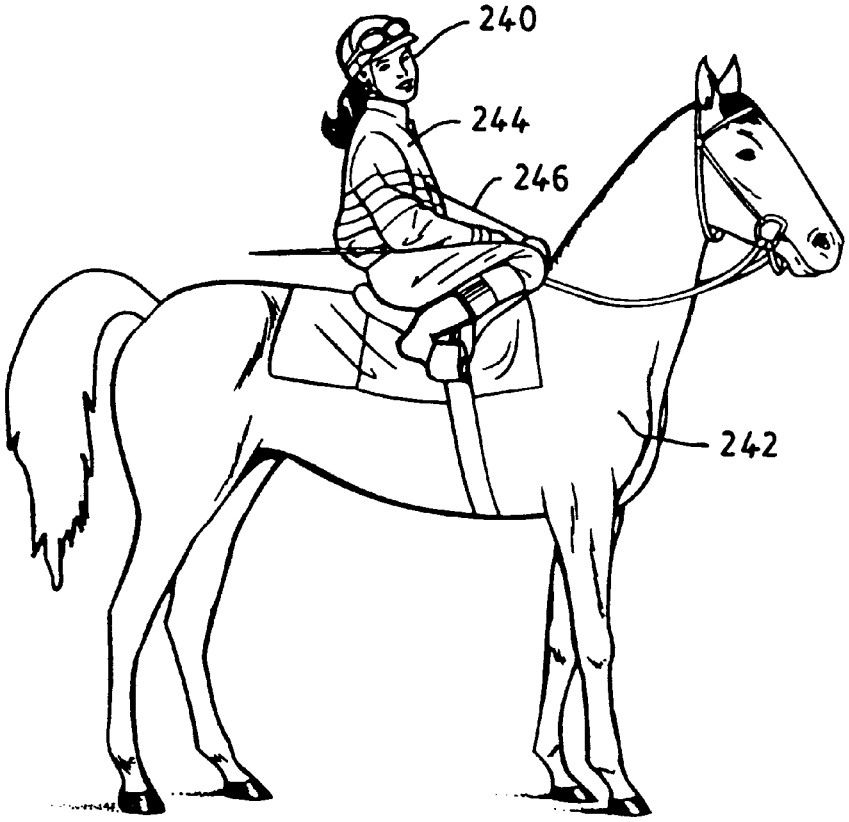
Figure 12B:
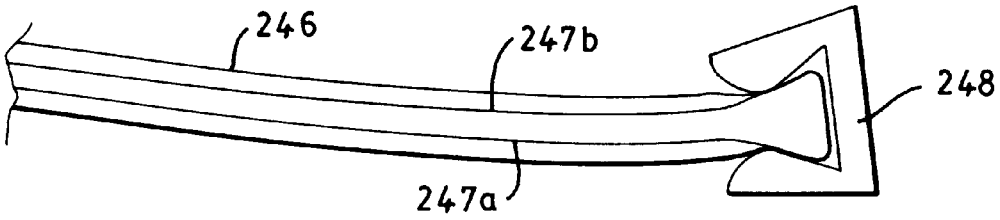

Another proximity device, according to the invention, is shown in FIG. 12A, where the jockey 240 is "tethered" to the horse 242. Specifically, the jacket 244 of this embodiment is connected to the horse 242 by way of a circuit string 246. Once the jockey 240 leaves the horse 242, such as by being thrown from the horse 242 during a race, the tether 246 breaks, and the circuit to the microprocessor is tripped, causing the jacket 244 to actuate. The circuit string 246 functions, by way of example, with a parallel set of wires 247 within the string 246, such as shown in FIG. 12B. The circuit is completed when the string is connected to the horse, where the connector 248 is a conductor that bridges the gap between the two wires 247. Accordingly, when the string 246 is withdrawn from the conductor 248, the circuit trips and the microprocessor commands the actuation of the jacket 244. The length of the tether 246 is selected to provide sufficient time for actuation after leaving the horse 242.

The sensors of FIGS. 12–12B are illustrative. Other sensors, known to those skilled in the art, can be constructed and connected in accord with the invention. By way of example, a pressure sensor or capacitive sensor can be utilized which senses the jockey's presence on the horse; and which generates signal to the microprocessor once the pressure or capacitance changes, providing the logic to determine that the jockey has left the horse.

Figure 13:
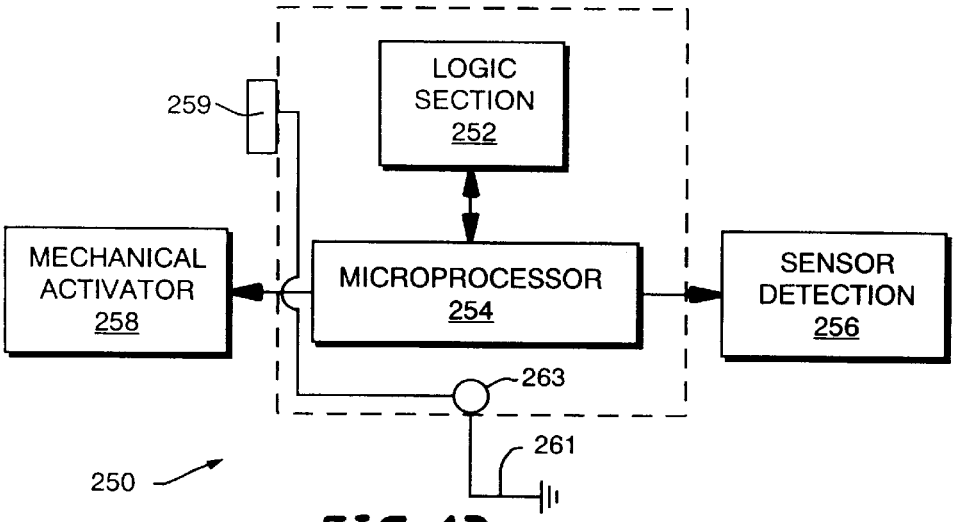
FIG. 13 schematically shows control electronics, constructed according to the invention, for sensing and controlling the jacket sensors and actuation mechanisms.

In the preferred embodiment, the jacket of the invention includes an "ON" and "OFF" switch, whereby the microprocessor within the jacket is activated by human control, such as right before a race. FIG. 13, for example, illustrates one circuit 250 that is sewn into the jacket of the invention and which includes a logic section 252—to assess certain signals relevant to sensors connected with or communicating with the jacket—and a microprocessor 254, to receive and command signals, respectively, from and to the proximity sensor 256 and mechanical actuator 258. By way of example, the sensor 256 can include one of (1) an accelerometer connected for communication with the circuit 250 to detect signals representing a person leaving a vehicle and/or hitting the ground after a fall; (2) a proximity sensor such as described above, like the tether; (3) and a radio-frequency or microwave frequency receiver, such as described below. The mechanical actuator 258, on the other hand, can include, for example, (1) a pyro to activate the gas generator; and (2) a mechanical valve such as the valve 40 of FIG. 3A.

An "ON" and "OFF" switch 259 provides a means for the user of the jacket to manually control whether the jacket can actuate by sensors and other mechanisms described herein. The switch 259 controls, for example, the electrical supply 261 to the elements 252, 254, through relay element 263.

Figure 13A:
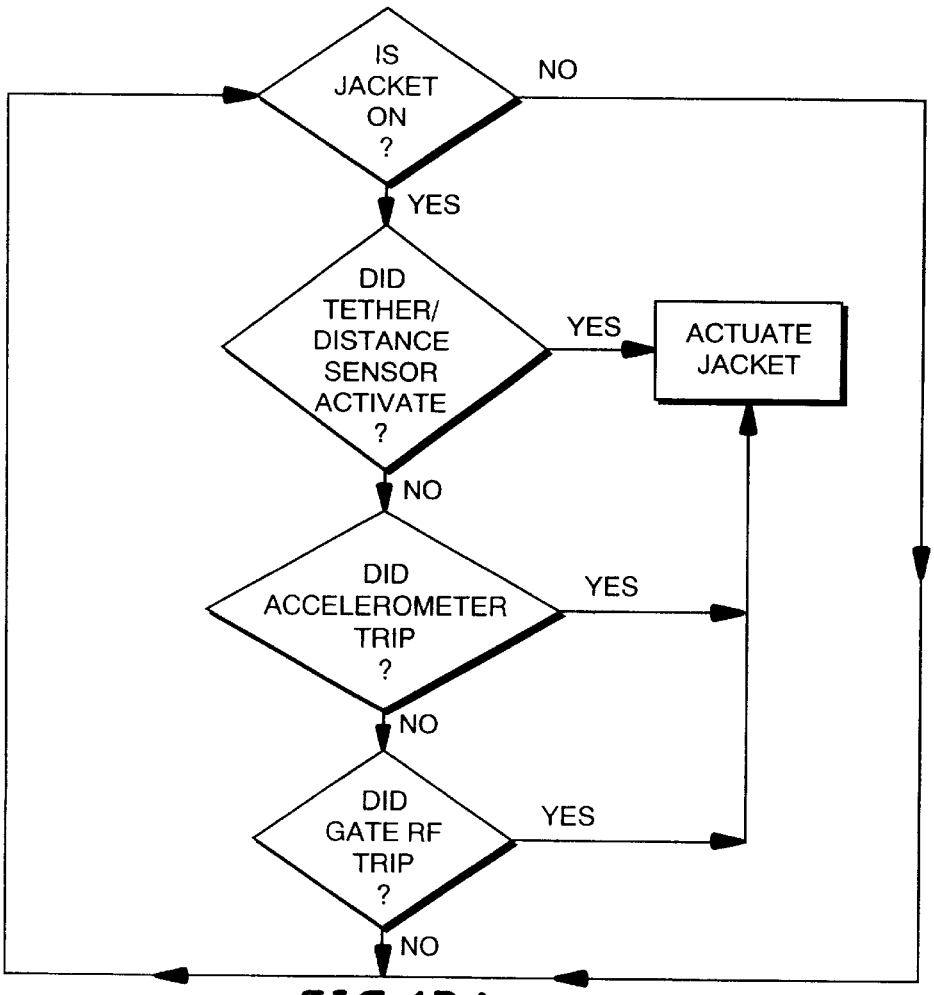
FIG. 13A shows representative logic for use with a logic section shown in FIG. 13.

The logic decisions associated with any and all of these sensors is made by the logic section 252. FIG. 13A, for example, illustrates acceptable flow and decision making methodology for use with the logic section 252. As illustrated, any and all sensors within the jacket sense associated quantities, e.g., the accelerometer senses forces of acceleration, and send signals to the microprocessor 254, which in turn communicates with the logic section 252 to decide when to actuate the jacket, such as by activating the gas generator to pump up the various air pockets. Suitable mechanical actuators, according to the invention, are provided by (1) PCB Piezotronics, Inc., of Depew, N.Y., in a miniature triaxial accelerometer with model number 339B11 and which weighs less than 3.5 grams and which operates with an output of 10 mV/g over 0.7–7000 Hz; and (2) EGG, of Milpitas, Calif., in milli-volt output accelerometers and 0–5000 PSI-rated pressure sensors.

Figure 14:
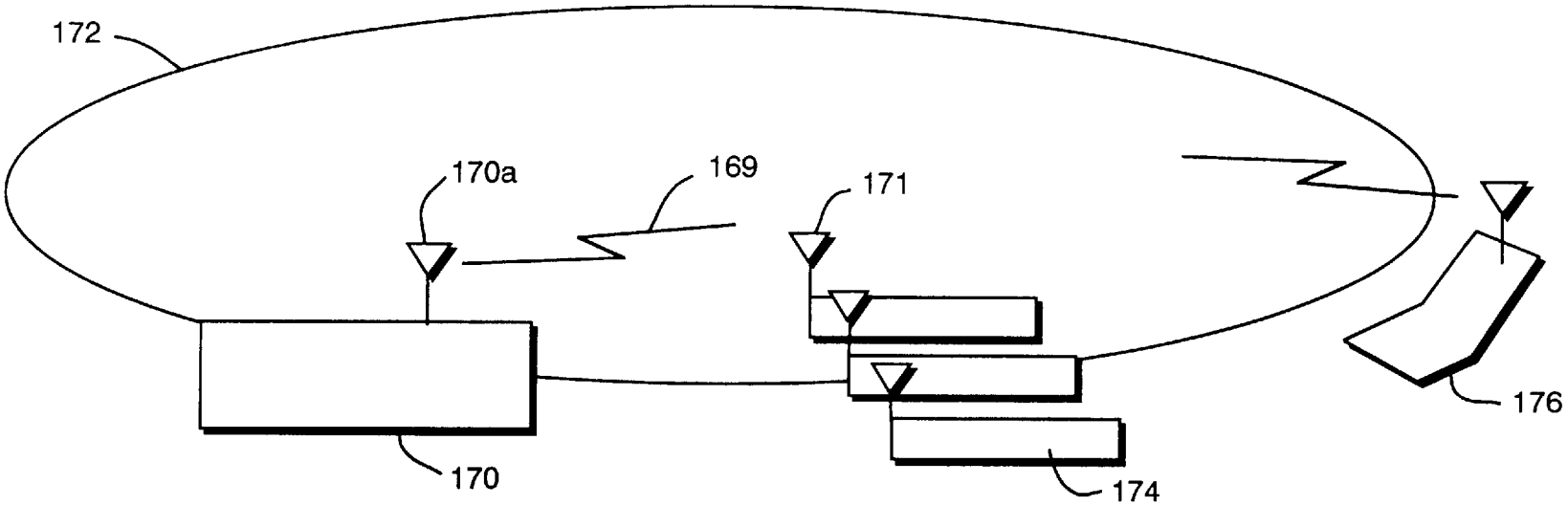
FIGS. 14 and 14A illustrate a remote signaling and actuation system, constructed according to the invention, which activates the jockey jackets at the start of a race and which deactivates the jackets at the end of a race.

FIG. 14 illustrates a preferred embodiment of the invention whereby the jacket, described herein,—is actuated through electromagnetic waves 169, e.g., radiofrequency or microwaves, from the starting gate 170 of a racecourse 172. The gate 170 includes a radiofrequency communicator with antenna 170*a* to communicate with the sensors 171 at any of the jockey/racehorses 174. At the start of the race, the gate 170 activates the jackets in a manner similar to the "ON" and "OFF" switch 259 of FIG. 13. Thereafter, the jackets act independently from the gate 170, and actuate upon detecting selected events, such as described in connection with FIGS. 12–12A. At the completion of the race, the exit gate 176 commands the jackets to deactivate, so that the jackets do not actuate unnecessarily, such as by dismounting from a horse and being tethered to the horse.

The devices which detect the electromagnetic energy are known in the art. By way of example, U.S. Pat. No. 5,030,807, entitled "System for Reading and Writing Data from and Into Remote Tags," provides general and useful information to encode and transmit data remotely, and is hereby incorporated by reference. Likewise, the following U.S. Patents provide additional detail and useful information, such as: U.S. Pat. No. 4,739,328, entitled "System for Identifying Particular Objects;" and U.S. Pat. No. 5,086,389, entitled "Automatic Toll Processing Apparatus," each of which is incorporated herein by reference.

Several of these prior art devices are used commercially by turnpike authorities to provide automatic toll adjustments to a creditcard-like transponder, such that a user does not have to physically stop to pay the toll. Similarly, the invention activates a creditcard-like circuit, e.g., an IC such as IC 120*a* of FIG. 7, housed within the jacket; and, once activated by the starting gate, the jacket is in an "ON" mode. Thus, for example, the gate 170 can activate all jockeys simultaneously by one signal generated from the gate 170 at the beginning of the race, such as when the announcer says "and they're off." A similar system turns all riders to an "OFF" mode at the finish gate 176.

The advantages of the system of FIG. 14 are several. For example, once the circuits within the jacket are activated, the race is active and jockeys to not leave their horse until the race is over, unless, for example, there is an accident. Therefore, alone or in combination with a proximity sensor such as described above, such as the tether, there is high confidence that the jacket of the invention will actuate when needed. The invention is also practical in that jockeys must dismount regularly prior to a race, usually because of operational difficulties such as late bets, mechanical difficulties with the starting gate, and unruly horses. Accordingly, the RF communications facilitate practical protection without physically connecting the jockey to the horse. Other embodiments, such as the mechanical tether, provide easy disengagement from the horse. As such, races are not unnecessarily held up or otherwise delayed by inappropriate jacket inflation or actuation. Time and efficiency are very important measures in a race setting; and the jacket of the invention does little to negatively impact these factors.

Remote activation and deactivation can also accomplished with a radio-frequency (RF) link between a command console and the jacket. A small low power transmitter within line-of-sight of the jacket's control electronics is triggered either manually or automatically, such as through the starting gate. Once triggered, the transmitter will modulate a digital code onto a carrier frequency and transmit the signal. Within the jacket's control electronics, a small thin wire (several inches long), e.g., such as shown as illustratively shown as sensor 171, FIG. 14, picks up the transmitted RF energy. Detectors within a receiver, also built into the jacket control electronics, thereafter extract the digital code from the carrier frequency. Valid, recognized codes will either activate or deactivate the operation of the protective device, such as known to those skilled in the art. The use of digital codes provides a measure of security that will prevent false activation or deactivation from spurious noise signals.

In a more complex control method, transponders instead of simple receivers are used to verify the operational status of the jacket's control circuitry. A transponder transmits and receives digitally encoded signals. Activation and deactivation is thus accomplished, as described above, by the command console broadcasting of a digital code to all jackets simultaneously. Each transponder responds to the activation command by transmitting a unique digital code. Each transponder is assigned a different unique code, such as the horse number. A computer at the command. console verifies a positive response from each of the control electronics prior to allowing the starting gates to open.

Figure 14A:
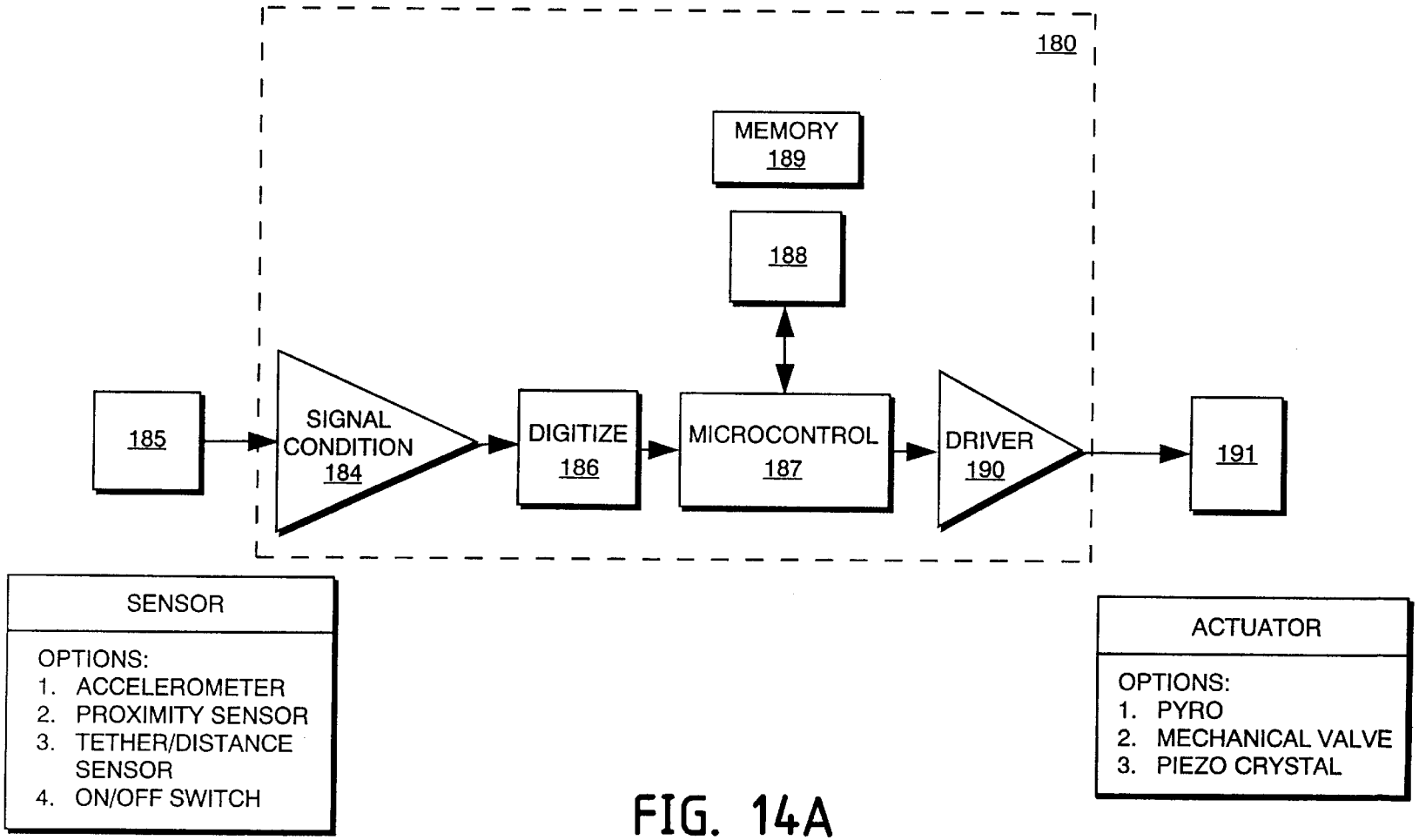

FIG. 14A illustrates representative control electronics 180. An IC 182 houses a series of electrical components, such as a signal conditioner 184 that is connected to the sensor 185 (e.g., the proximity sensor described above). The conditioner 184 conditions the signal input to the IC 182, to reduce noise and other artifacts. That signal is digitized by digitizer 186 and input to the microcontroller 187, which undertakes overall operation of the IC 182. The microcontroller 187 communicates with the logic section 188 and memory 189 to make command decisions, such as to actuate the jacket. Once the decision to actuate is commanded, a driver 190 is activated to engage a mechanical actuator 191, such as a pressure valve shown in FIG. 3.

Figure 15:
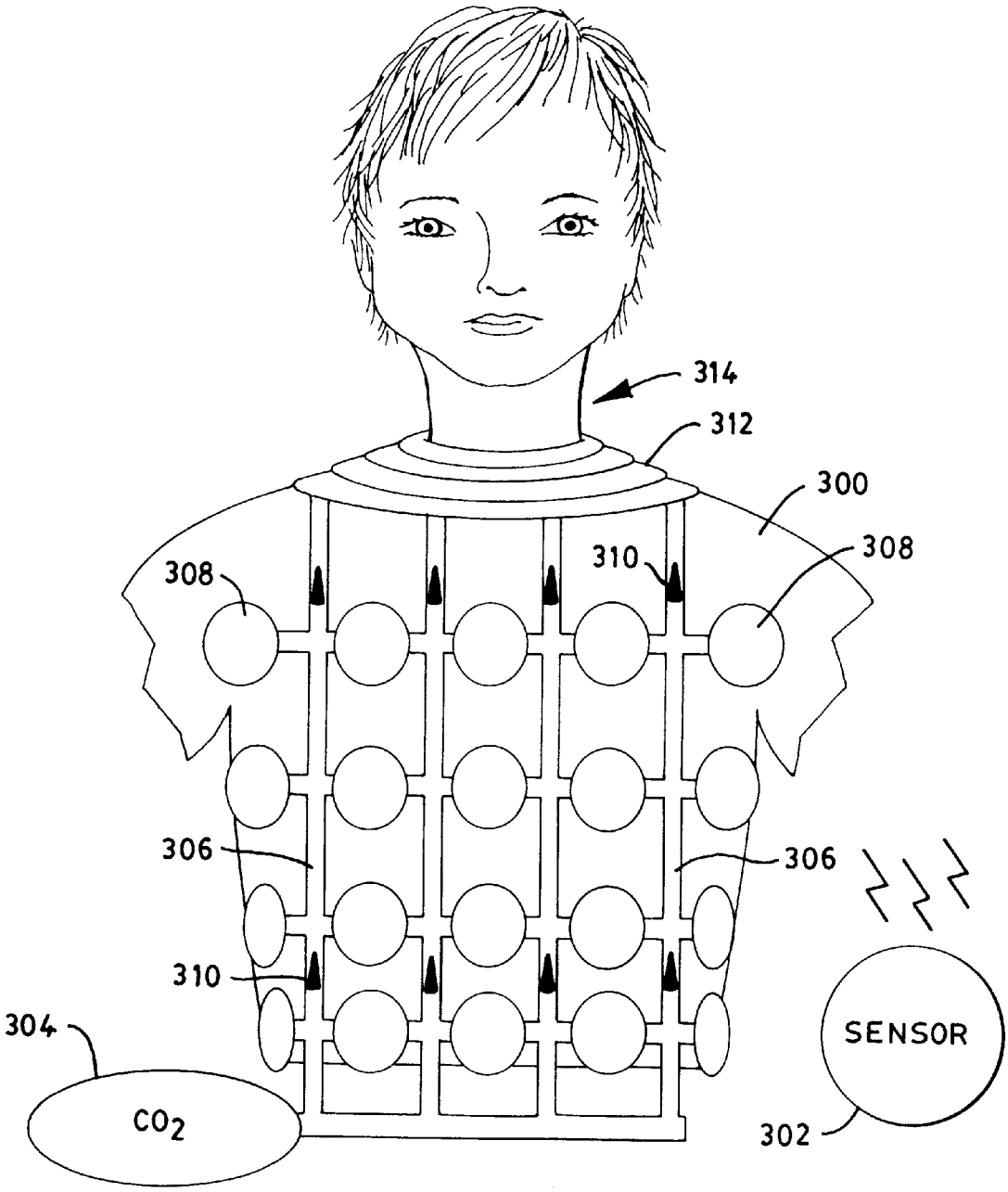
FIGS. 15–15D illustrate one jockey jacket, constructed according to the invention, and in several operational modes before and after sensing and actuating the jacket.
Figure 15A:
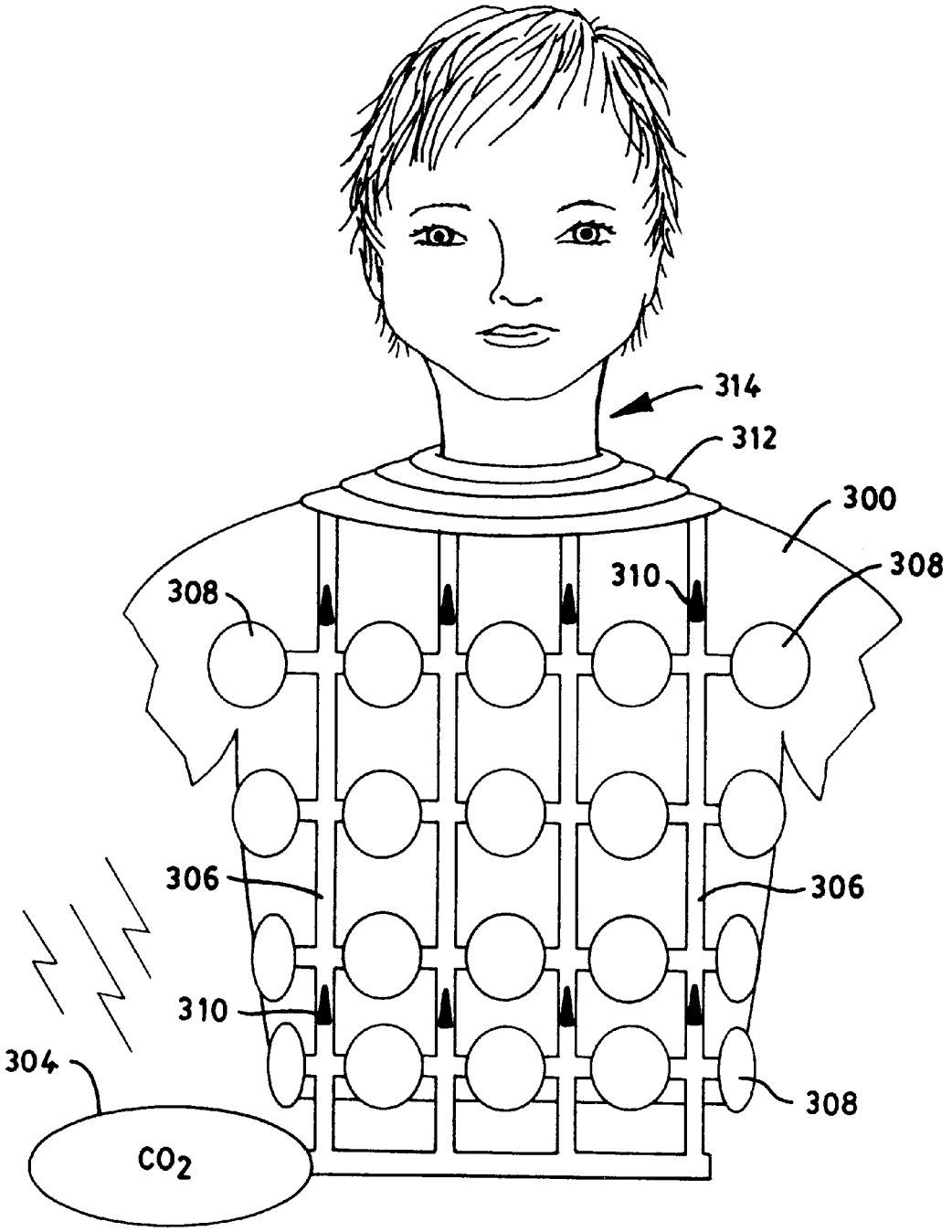

FIGS. 15–15E illustrate selected features of the invention and in a series of operational modes. In FIG. 15, for example, a jockey jacket 300 has a sensor 302 arranged within the jacket 300 to sense and detect the jockey falling from a horse. The sensor 302 can be any of the sensors described above, including the tether 246 of FIG. 12A and the remote receiver 171 of FIG. 14, and is illustratively shown outside the jacket 300 for purposes of illustration. Once the sensor 302 detects the terminal event, the sensor 302 and the control electronics, such as described herein, actuate the mechanical actuator 304 (here shown as a $CO_2$ cartridge), causing air to be pumped into the jacket 300, such as shown in FIG. 15A.

The series of tracks 306 function to funnel the gas from the generator 304 into the jacket 300 and into the several air-pockets 308. The many caps 310 are disposed within the tracks 306 and are forced upwards when the generator 304 pumps air into the jacket 300 (note, again, that the generator 304 is shown outside the jacket 300, for illustrative purposes).

A series of concentric cylinders 312 is also connected to the tracks 306 so that they can be pumped up to protect the jockey's neck area 314.

Figure 15B:
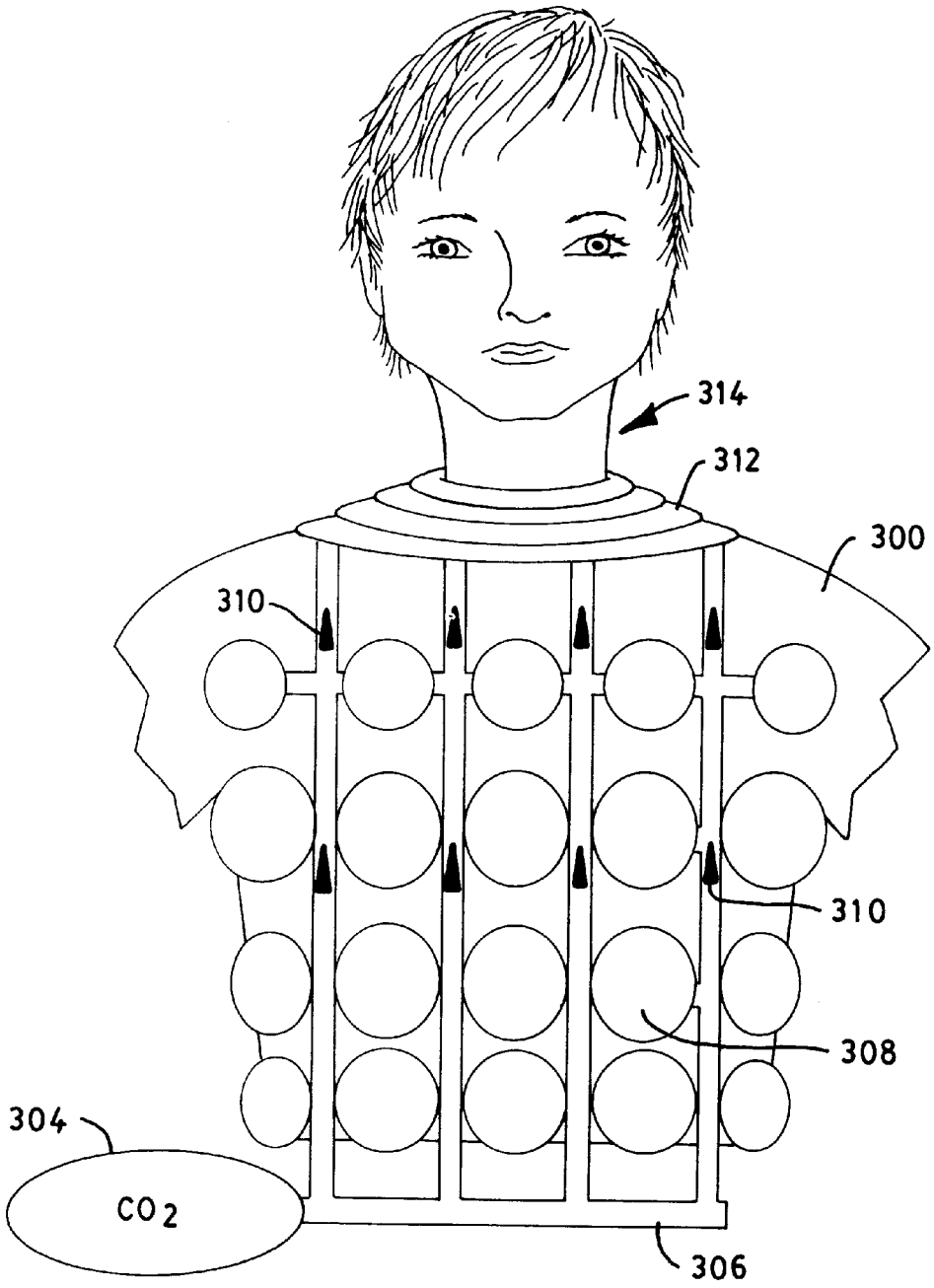
Figure 15C:
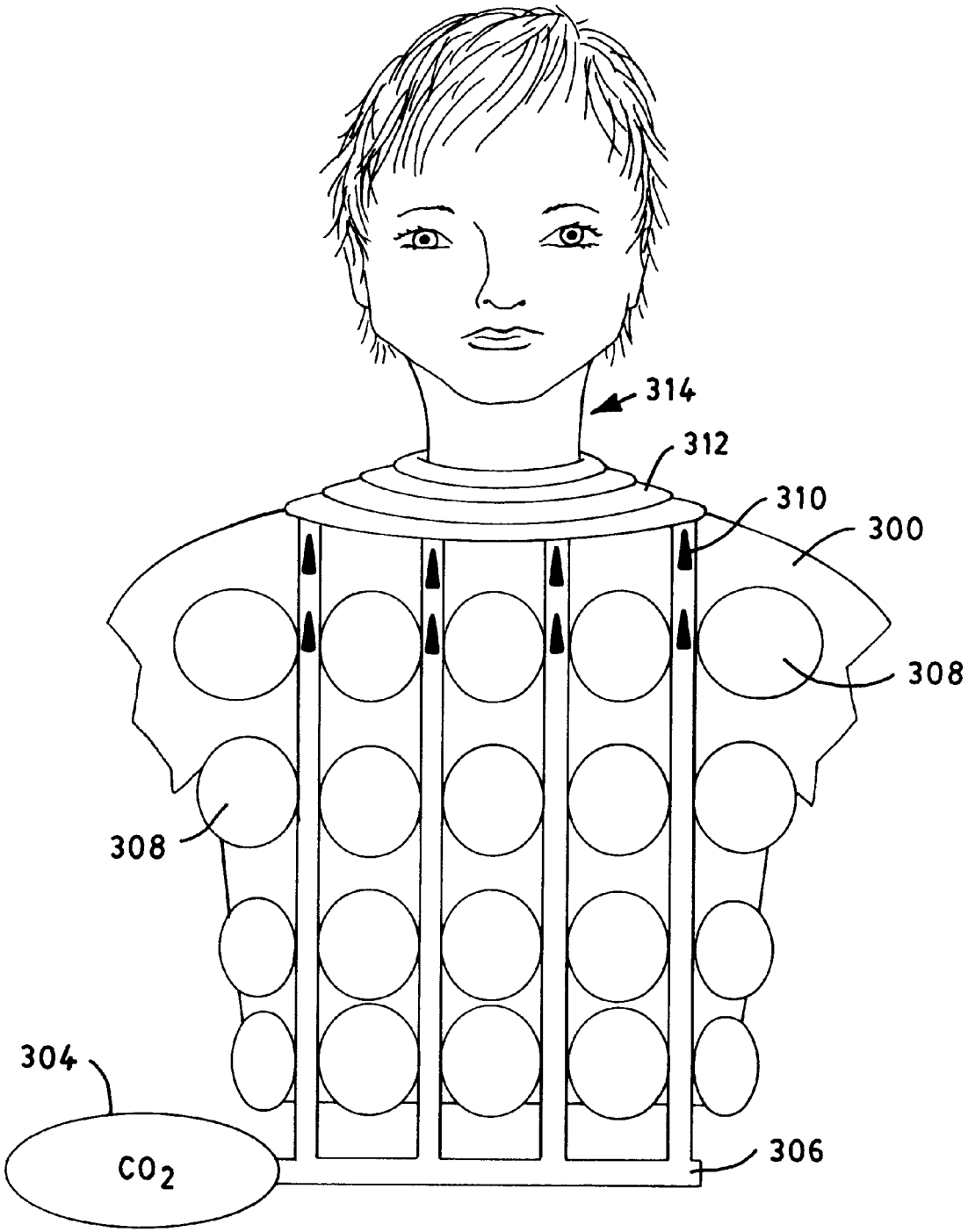

FIGS. 15B and 15C illustrate the movement of the caps 310 along the tracks 306, which occurs while the jacket 300 is being actuated. These figures also illustrate how the pockets 308 are pumped tip, becoming larger during actuation.

Figure 15D:
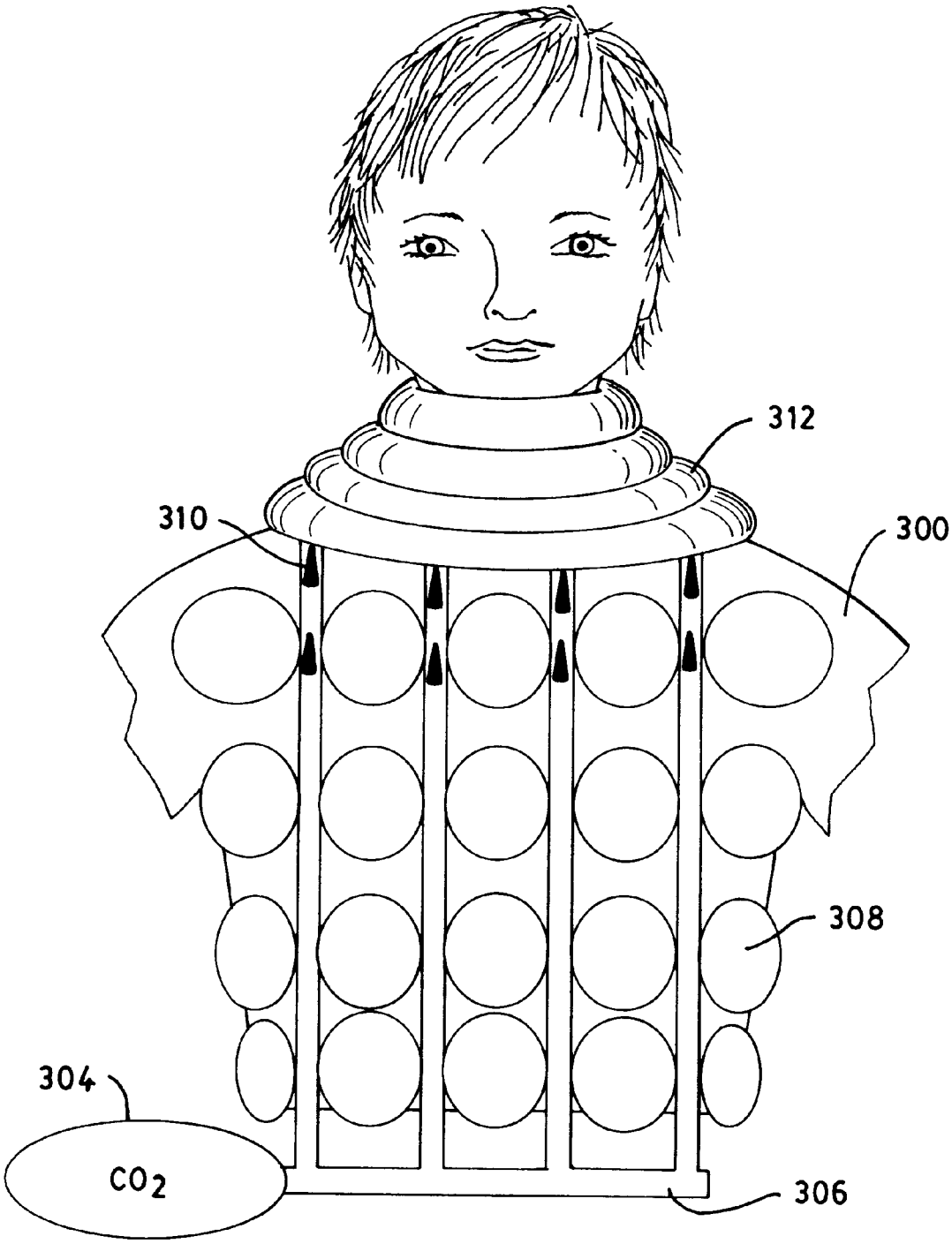

FIG. 15D illustrates the fully actuated jacket 300, where the neck area 314 is covered by the expanded cylinders 312 and the columns 314, formed by the several caps 310.

Those skilled in the art should appreciate that changes can be made within the description above without departing from the scope of the invention. For example, nylon fabrics are suitable for use with the invention, particularly with respect to the airbag construction. One airbag manufacturing technology particularly suited for the invention is provided by the Precision Fabrics Group, of Greensboro, N.C., which provides an airbag that packs into a much smaller volume than conventional airbags and with a weight that is less than one-half that the other conventional airbags.

Expansible nylon fabrics are particularly good absorbers of kinetic energy, and can be calibrated with the variables expected during normal usage, such as the pressure-temperature-time history of a given impact event. Further, significant amounts of data has been gathered and analyzed by the automobile airbag industry; and that data indicates good overall engineering properties and energy absorption through viscous dissipation, biaxial stretching., and gaseous flow. By way of example, "Kinetic Energy Adsorption by Expansible Nylon Fabrics," by R. W. Tock and G. Nusholtz, Department of Chemical Engineering, Texas Tech University, pg. 2480—2486, ANTEC (1993), provides useful airbag calculations and design criterion for airbag kinetic energy adsorption; and is thus incorporated herein by reference. Another useful article relative to the bursting strength of plastic films is provided by "An Investigation on Plastic Pneumatic Bursting Strength of Plastics Films," by H. Tseng et al., pgs. 508—511, ANTEC (1990), and is also incorporated herein by reference.

The invention thus attains the objects set forth above, among those apparent from preceding description. Since certain changes may be made in the above apparatus and methods without departing from the scope of the invention, it is intended that all matter contained in the above description or shown in the accompanying drawing be interpreted as illustrative and not in a limiting sense.

It is also to be understood that the following claims are to cover all generic and specific features of the invention described herein, and all statements of the scope of the invention which, as a matter of language, might be said to fall there between.

Having described the invention, what is claimed as new and secured by Letters Patent is:

1. A jacket for protecting a wearer from injury during a fall from a vehicle, comprising:

at least one layer forming a jacket;

a plurality of airpockets woven into the jacket, each of the airpockets being in fluid communication with other airpockets and being expandable in response to increased pressurization;

a gas generator for pressurizing the airpockets, and one or more pressurization tubes to communicate gas between the gas generator and the airpockets;

regulator means for controlling gas flow between the gas generator and the airpockets, the regulator means being responsive to a signal generated when the wearer of the jacket falls from the vehicle;

pressure sensing means for sensing pressure within at least one of the airpockets and for generating a pressure signal representative of the pressure; and pressure regulation means, including microprocessor means, connected to the pressure sensing means for controlling pressurization within the airpockets by controlling the flow of gas into or out of the airpockets in response to the pressure signal.

2. A jacket according to claim 1, wherein the vehicle is selected from the group consisting essentially of a horse, a motorcycle, a snowmobile, a bobsled, and a bicycle.

3. A jacket according to claim 1, further comprising a plurality of mini-airbags sewn within the jacket and connected to the gas generator by a plurality of gas conduits, the mini-airbags being responsive to increased pressurization to provide cushioning within the jacket, and wherein the regulator means further comprises means for controlling gas flow from the gas generator through the conduits and to the mini-airbags.

4. A jacket according to claim 1, wherein the jacket has a collar portion and further comprising one or more circular cylinders connected to the collar portion, the cylinders being connected to the gas generator by one or more pressurization tubes, the cylinders being expandable in response to increased pressurization to substantially surround the wearer's neck to create a resistance against sideways movement of the wearer's head.

5. A jacket according to claim 1, wherein the pressure regulation means comprises valve means for releasing pressure from the airpockets in response to signals generated by the microprocessor means.

6. A jacket according to claim 1, wherein the pressure regulation means comprises valve means, connected to a gas generator, for injecting air into the airpockets in response to signals generated by the microprocessor means.

7. A jacket according to claims 1, wherein the pressure regulation means further comprises means for controlling the pressurization within the airpockets according to a non-linear function of pressure and time.

8. A jacket according to claim 1, wherein the jacket has a collar portion, and further comprising:

a base webbing woven within the jacket, the webbing extending circumferentially about the jacket and in a horizontal position relative to a normal upward posture of a wearer of the jacket;

a collar structure within the collar region of the jacket, the collar structure being substantially rigid and extending circumferentially about the collar region such that the collar structure surrounds at least part of the neck of a wearer of the jacket;

a plurality of tracks, woven within the jacket and arranged substantially vertically between a base of the jacket and the collar portion; and a plurality of caps within each of the tracks, the caps formed of a sturdy material and being responsive to pressurization within the tracks to accelerate towards the neck, the lower-most cap connecting to the base webbing once the lower-most cap accelerates past the base webbing, the caps forming a substantially rigid column, thereby forming an exo-skeleton about the neck and protecting the neck during the fall.

9. A jacket according to claim 8, further comprising a upper-most cap within each of the tracks, the upper-most cap being connected to the collar structure to provide a connection point to facilitate column formation.

10. A jacket according to claim 8, further comprising a web access to remove the base webbing from the jacket selectively.

11. A jacket according to claim 8, further comprising a blocking element within one or more caps, the blocking element preventing adjacent and lower caps from engaging and connecting with adjacent and upper caps.

12. A jacket according to claim 8, further comprising a helmet and at least two straps connected to the helmet, each of the straps connected with one of the tracks such that the column connects substantially into the helmet.

13. A jacket according to claim 1, wherein the jacket has a collar portion and further comprising a plurality of circular cylinders connected to the collar portion, each of the cylinders having a different radial size, the cylinders being arranged sequentially according to radial size, with smaller radial cylinders on top of larger radial cylinders, the cylinders being connected to the gas generator by the pressurization tubes, the cylinders being arranged expandable in response to increased pressurization to substantially surround the wearer's neck to create a resistance against sideways movement of the wearer's head.

14. A jacket according to claim 1, wherein the jacket material forms a vest-like jacket.

15. A jacket according to claim 1, wherein the jacket material forms a jump-suit jacket, the jump suit jacket having one or more airpockets surrounding a buttocks region of the jacket, thereby protecting a wearer of the jacket against compression injury.

16. A jacket according to claim 1, wherein the layer are formed of material selected from the group consisting essentially of ballistic nylon, polyurethane, rubber with cloth covers, vinyl and textiles that are heat sealed and sewn, steel reinforced aramid neoprene with aramid fiber reinforcement, polyethylene, polypropylene, polyester, and acetate.

17. A jacket according to claim 1, further comprising means for releasing gas from the jacket after about five seconds after pressurization.

18. A jacket according to claim 1, wherein the regulator means comprises:

a proximity sensor for providing information about the wearer's position relative to the vehicle;

a microprocessor connected to the actuation sensor, and further connected to a logic section, the logic section providing logic flow for determining when to actuate the gas generator based upon information from an actuation sensor; the microprocessor generating the signal in response to the logic flow from the logic section.

19. A jacket according to claim 18, wherein the proximity sensor is selected from the group consisting essentially of a tether, a pressure sensor, a capacitive sensor, and an accelerometer.

20. A jacket according to claim 18, further comprising switch means, connected to the microprocessor, for turning the microprocessor on and off.

21. A jacket according to claim 18, wherein the regulator means further comprises a radio-frequency receiver, wherein the receiver is responsive to radiowaves generated nearby to the jacket to activate the regulator means such that the regulator means is responsive to the signal.

22. A jacket according to claim 18, wherein the microprocessor and logic section are formed within an integrated circuit.

23. A method for protecting a jockey during a fall from a horse, comprising the steps of:

sensing information indicative of the jockey falling from the horse;

generating a pressurization signal, in response to the information, to pressurize a jacket worn by the jockey, the jacket having a gas generator, responsive to the pressurization signal, and a plurality of airpockets, connected to the gas generator, that are expandable with pressurization to cushion the jockey;

sensing pressure within at least one of the airpockets and generating a pressure signal representative of the pressure;

controlling pressurization within the airpockets by controlling the flow of gas into or out of the airpockets in response to the pressure signal; and controlling gas flow between the gas generator and the airpockets to provide a substantially smooth landing during the fall.

* * * * *